US011587512B2

(12) United States Patent
Zhang et al.

(10) Patent No.: US 11,587,512 B2
(45) Date of Patent: Feb. 21, 2023

(54) DISPLAY PANEL AND DISPLAY DEVICE

(71) Applicants: WUHAN TIANMA MICROELECTRONICS CO., LTD., Wuhan (CN); WUHAN TIANMA MICROELECTRONICS CO., LTD. SHANGHAI BRANCH, Shanghai (CN)

(72) Inventors: Mengmeng Zhang, Wuhan (CN); Yue Li, Wuhan (CN); Xingyao Zhou, Wuhan (CN)

(73) Assignees: WUHAN TIANMA MICROELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/544,909

(22) Filed: Dec. 7, 2021

(65) Prior Publication Data

US 2022/0101797 A1 Mar. 31, 2022

(30) Foreign Application Priority Data

Aug. 4, 2021 (CN) ..... 202110891830.8

(51) Int. Cl.
*G09G 3/3266* (2016.01)

(52) U.S. Cl.
CPC ... *G09G 3/3266* (2013.01); *G09G 2310/0289* (2013.01)

(58) Field of Classification Search
None
See application file for complete search history.

(56) References Cited

U.S. PATENT DOCUMENTS

2015/0015554 A1* 1/2015 Kim ..... G09G 3/3266 345/208
2016/0019833 A1* 1/2016 Wei ..... G09G 3/3233 345/77
2018/0350306 A1* 12/2018 Zhang ..... G09G 3/3233
2019/0206291 A1* 7/2019 Liu ..... H01L 27/124
2019/0295450 A1* 9/2019 Xi ..... G09G 3/20
(Continued)

FOREIGN PATENT DOCUMENTS

CN 104658475 A 5/2015

*Primary Examiner* — Nitin Patel
*Assistant Examiner* — Amen W Bogale
(74) *Attorney, Agent, or Firm* — Kilpatrick Townsend & Stockton LLP

(57) ABSTRACT

Provided are a display panel and a display device. The display panel includes rows of pixels and a gate driver circuit; where a pixel among the plurality of rows of pixels includes a pixel circuit and the pixel circuit includes a light emission control terminal and a first scan drive terminal; the gate driver circuit includes stages of light emission drive devices, where each of the plurality of stages of light emission drive devices is disposed in correspondence to at least one row of pixel circuits and configured to provide a light emission control signal to the light emission control terminal of the pixel circuit; and the gate driver circuit further includes at least one stage of first scan drive device, where an input terminal of the first scan drive device is connected to an output terminal of the light emission drive device.

19 Claims, 13 Drawing Sheets

(56) References Cited

U.S. PATENT DOCUMENTS

| | | | | |
|---|---|---|---|---|
| 2020/0388227 | A1* | 12/2020 | Yang | G09G 3/3266 |
| 2022/0208075 | A1* | 6/2022 | Kim | G11C 19/28 |
| 2022/0301497 | A1* | 9/2022 | Zhang | G09G 3/32 |

* cited by examiner

DISPLAY PANEL AND DISPLAY DEVICE

CROSS-REFERENCE TO RELATED APPLICATION(S)

This application claims priority to Chinese Patent Application No. 202110891830.8 filed Aug. 4, 2021, the disclosure of which is incorporated herein by reference in its entirety.

TECHNICAL FIELD

Embodiments of the present disclosure relate to the field of display technology and, in particular, to a display panel and a display device.

BACKGROUND

With the progress and development of science and technology and the improvement of people's standard of living, a display panel has been deeply used in various electronic products. Therefore, the display panel is manufactured in large quantity and an increasingly high requirement is imposed on the display of the display panel.

In the current manufacturing process of the display panel, how to improve the screen-to-body ratio of the display panel becomes a primary requirement for improving a display effect.

SUMMARY

Embodiments of the present disclosure provide a display panel and a display device to achieve a narrow bezel.

The embodiments of the present disclosure provide a display panel which includes rows of pixels and a gate driver circuit.

A pixel among the plurality of rows of pixels includes a pixel circuit and the pixel circuit includes a light emission control terminal and a first scan drive terminal.

The gate driver circuit includes stages of light emission drive devices, where each of the plurality of stages of light emission drive devices is disposed in correspondence to at least one row of pixel circuits and configured to provide a light emission control signal to the light emission control terminal of the pixel circuit.

The gate driver circuit further includes at least one stage of first scan drive device, where an input terminal of the first scan drive device is connected to an output terminal of the light emission drive device, an output terminal of the first scan drive device is connected to the first scan drive terminal of the pixel circuit, and the first scan drive device is driven by the light emission control signal to provide a first scan drive signal to a row of pixels; and the output terminal of the light emission drive device is connected to the light emission control terminal.

Based on the same inventive concept, the embodiments of the present disclosure further provide a display device. The display device includes the preceding display panel.

BRIEF DESCRIPTION OF DRAWINGS

Embodiments of the present disclosure are described, using the drawings in the description of the embodiments briefly described hereinafter. While the drawings in the following description are some embodiments of the present disclosure, these drawings may be expanded and extended to other structures and drawings according to the basic concepts of the device structure, driving method, and manufacturing method disclosed and indicated in embodiments of the present disclosure. These are within the scope of the claims of the present disclosure.

DETAILED DESCRIPTION

Embodiments of the present disclosure are described hereinafter with reference to drawings of embodiments of the present disclosure and in conjunction with implementations. The embodiments described herein are some embodiments, not all embodiments, of the present disclosure.

Figure 1:
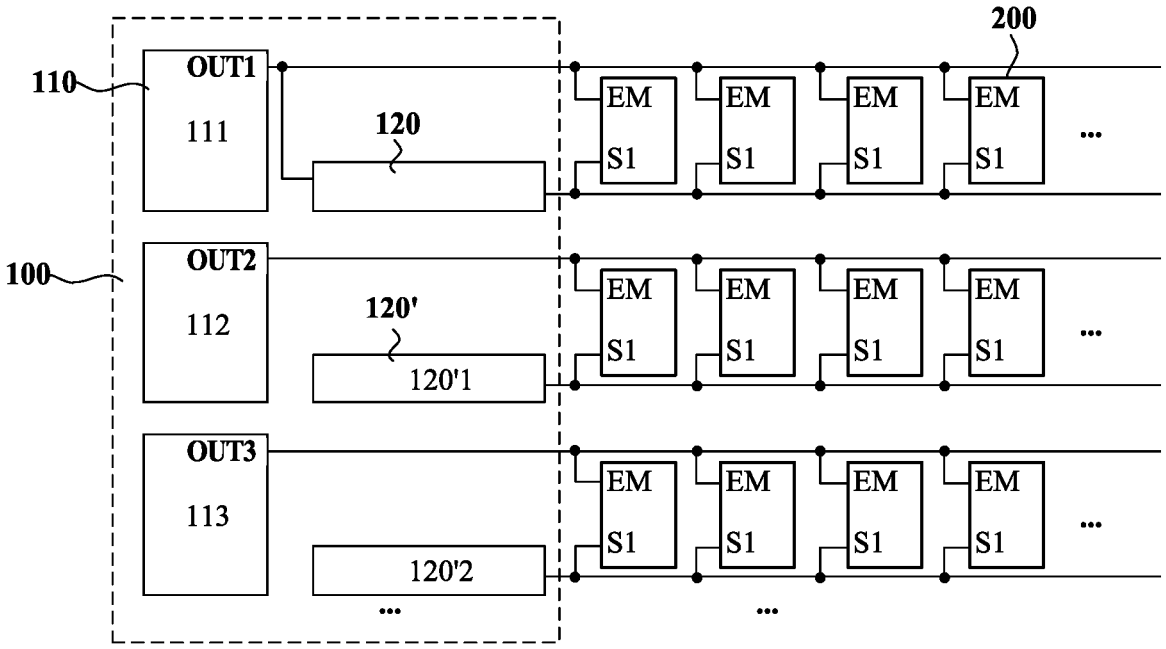
FIG. 1 is a schematic diagram of a display panel according to an embodiment of the present disclosure.

Referring to FIG. 1, FIG. 1 is a schematic diagram of a display panel according to an embodiment of the present disclosure. The display panel according to the present embodiment includes rows of pixels and a gate driver circuit 100. A pixel among the plurality of rows of pixels includes a pixel circuit 200 and the pixel circuit 200 includes a light emission control terminal EM and a first scan drive terminal S1. The gate driver circuit 100 includes stages of light emission drive devices 110, and each of the plurality of stages of light emission drive devices 110 is disposed in correspondence to at least one row of pixel circuits 200 and provides a light emission control signal to the light emission control terminal EM of the pixel circuit 200. The gate driver circuit 100 further includes at least one stage of first scan drive device 120, where an input terminal of the first scan drive device 120 is connected to an output terminal OUT of the light emission drive device 110, an output terminal of the first scan drive device 120 is connected to the first scan drive terminal S1 of the pixel circuit 200, and the first scan drive device 120 is driven by the light emission control signal to provide a first scan drive signal to a row of pixels; and the output terminal of the light emission drive device 110 is connected to the light emission control terminal EM of the pixel circuit 200.

In the present embodiment, the display panel includes a display region and a non-display region. The plurality of rows of pixels are arranged in the display region of the display panel, each pixel includes the pixel circuit 200 and a light-emitting unit (not shown) electrically connected to each other, and the pixel circuit 200 drives the corresponding light-emitting unit to emit light or not. The gate driver circuit 100 is disposed in the non-display region of the display panel and drives rows of pixel circuits 200 in the display region to control light-emitting units in the display region to perform display.

The gate driver circuit 100 includes the plurality of stages of light emission drive devices 110 and each light emission drive device 110 is disposed in correspondence to at least one row of pixels. The plurality of stages of light emission drive devices 110 are sequentially marked as a light emission drive device 111, a light emission drive device 112, a light emission drive device 113 and so on. In an embodiment, the output terminal OUT of the light emission drive device 110 is electrically connected to the light emission control terminal EM of each pixel circuit 200 in the corresponding at least one row of pixels and the light emission drive device 110 is configured to provide the light emission control signal to the light emission control terminal EM of each pixel circuit 200 in the corresponding row.

It is to be noted that the correspondence between the light emission drive device and the number of rows of pixel circuits is different in different display panels. For example, one light emission drive device drives two or more rows of pixel circuits in some display panels, and one light emission drive device drives one row of pixel circuits in other display panels. The correspondence between the light emission drive device and the number of rows of pixel circuits is not specifically limited in the embodiments of the present disclosure. However, in the following embodiments and the drawings, an operating principle is described only using an example in which one light emission drive device drives one row of pixel circuits.

The gate driver circuit 100 further includes the at least one stage of first scan drive device 120. The first scan drive device 120 is electrically connected to the light emission drive device 110. In an embodiment, the input terminal of the first scan drive device 120 is connected to the output terminal OUT of the light emission drive device 110 and the first scan drive device 120 is disposed in correspondence to a row of pixels. The output terminal of the first scan drive device 120 is electrically connected to the first scan drive terminal S1 of each pixel circuit 200 in the corresponding row of pixels and the first scan drive device 120 is configured to provide the first scan drive signal to the first scan drive terminal S1 of each pixel circuit 200 in the row.

The pixel circuit 200 controls the light-emitting unit to emit light or not according to the light emission control signal and the first scan drive signal. It is to be understood that an input signal of the pixel circuit 200 for controlling the light-emitting unit to emit light or not includes, but is not limited to, the light emission control signal and the first scan drive signal. Generally, the input signal of the pixel circuit 200 further includes other drive signals, such as a scan_p scan drive signal, a data voltage signal and a power supply voltage signal. The details are not repeated here.

As shown in FIG. 1, the gate driver circuit 100 may include only one stage of first scan drive device 120. The input terminal of the first scan drive device 120 is electrically connected to the output terminal OUT of one of the plurality of stages of light emission drive devices 110 and the first scan drive device 120 provides the first scan drive signal to the first scan drive terminal S1 of each pixel circuit 200 in the corresponding at least one row. For other rows of pixels, the gate driver circuit 100 further includes scan1 drive devices 120' and the plurality of scan1 drive devices 120' are sequentially marked as a scan1 drive device 120'1, a scan1 drive device 120'2 and so on. The scan1 drive device 120' is disposed in correspondence to the light emission drive device 110 and provides the first scan drive signal to the first scan drive terminal S1 of each pixel circuit 200 in the corresponding at least one row.

In other embodiments, the gate driver circuit may further include two or more stages of first scan drive devices, where the number of stages of the first scan drive devices is lower than or equal to the number of stages of the light emission drive devices, and the first scan drive device provides the first scan drive signal to the first scan drive terminal S1 of each pixel circuit in the corresponding at least one row. For other rows of pixels, the gate driver circuit further includes at least one scan1 drive device and the scan1 drive device provides the first scan drive signal to the first scan drive terminal S1 of each pixel circuit 200 in the corresponding row.

Figure 2:
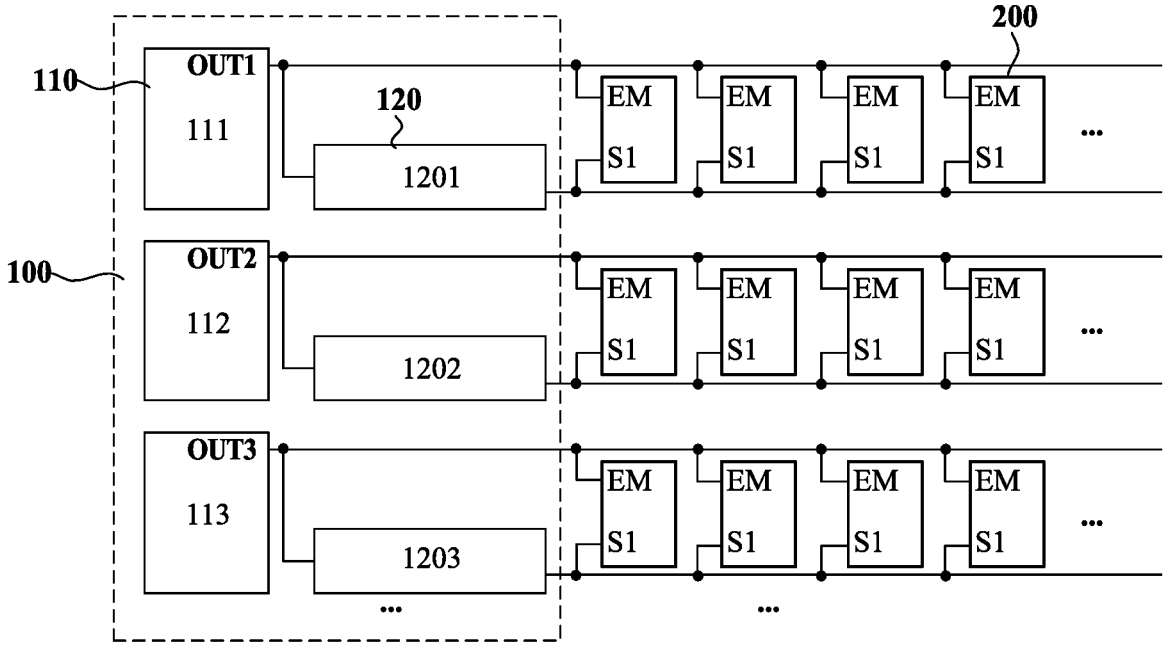
FIG. 2 is a schematic diagram of another display panel according to an embodiment of the present disclosure.

Referring to FIG. 2, FIG. 2 is a schematic diagram of another display panel according to an embodiment of the present disclosure. As shown in FIG. 2, the gate driver circuit 100 may include stages of first scan drive devices 120, where each of the plurality of stages of first scan drive devices 120 is disposed in correspondence to a respective one of the plurality of stages of light emission drive devices 110 and the input terminal of the first scan drive device 120 is connected to the output terminal OUT of the corresponding light emission drive device 110. Therefore, the first scan drive terminal S1 of each pixel circuit 200 in each row receives the first scan drive signal provided by the corresponding stage of first scan drive device 120. The plurality of stages of first scan drive devices 120 are sequentially marked as a first scan drive device 1201, a first scan drive device 1202, a first scan drive device 1203 and so on.

Figure 3:
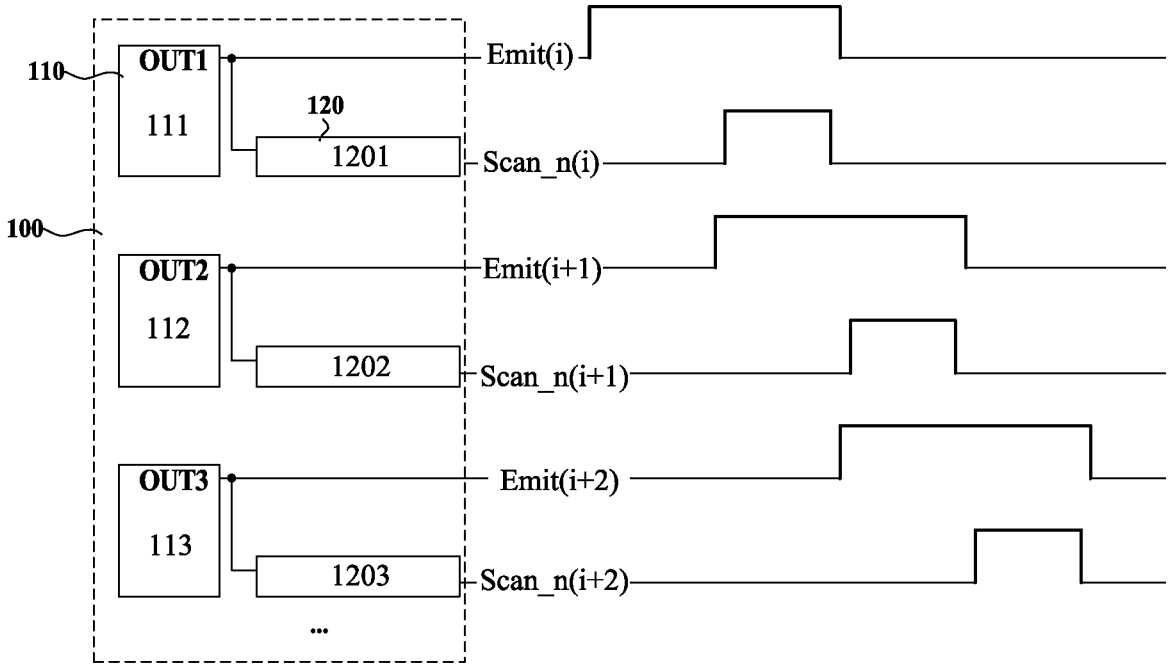
FIG. 3 is a timing diagram of a gate driver circuit according to an embodiment of the present disclosure.

It is to be noted that in the display panel according to the present embodiment, the transmission of the first scan drive devices 120 stage by stage depends on the light emission drive devices 110, to save a bezel. Referring to FIG. 3, FIG. 3 is a timing diagram of a gate driver circuit according to an embodiment of the present disclosure. As shown in FIG. 3, the plurality of stages of light emission drive devices 110 in the gate driver circuit 100 output the light emission control signals emit stage by stage to the light emission control terminal EM of the pixel circuit 200. The light emission control signals emit outputted stage by stage by the plurality of stages of light emission drive devices are sequentially marked as emit(i), emit(i+1), emit(i+2) and so on. It is to be noted that "i" here denotes the number of rows and "i" is a positive integer.

In the present embodiment, the input terminal of the first scan drive device 120 is connected to the output terminal OUT of the light emission drive device 110. The output terminal OUT of the light emission drive device 110 outputs the light emission control signal emit and the first scan drive device 120 receives the corresponding light emission control signal emit. If one stage of light emission drive device 110 is electrically connected to the corresponding one stage of first scan drive device 120, the light emission control signals emit outputted stage by stage by the plurality of stages of light emission drive devices 110 control the corresponding first scan drive devices 120 to operate stage by stage. The first scan drive signals (using the first scan drive signal scan_n as an example) outputted by the plurality of stages of first scan drive devices 120 stage by stage to the first scan drive terminal S1 of the pixel circuit 200 are sequentially marked as scan_n(i), scan_n(i+1), scan_n(i+2) and so on. It is to be noted that "i" here denotes the number of rows and "i" is a positive integer. The transmission of the plurality of stages of first scan drive devices 120 stage by stage is controlled by the light emission control signals emit outputted stage by stage by the plurality of stages of light emission drive devices 110 and structures such as signal lines for controlling the transmission of the first scan drive devices 120 stage by stage are not required to be arranged in the non-display region additionally, to save the bezel.

In the embodiments of the present disclosure, an output signal of the light emission drive device, the light emission control signal, serves as an input signal of the first scan drive device and the first scan drive device generates the first scan drive signal according to the light emission control signal and transmits the first scan drive signal to the pixel circuits to drive the pixels for display. In the embodiments of the present disclosure, the input terminal of the first scan drive device is electrically connected to the output terminal of the light emission drive device and the output terminal of the light emission drive device outputs the light emission control signal stably and the first scan drive device has relatively good stability, wires for driving the transmission of the first scan drive devices stage by stage separately are not required, a circuit structure is relatively simple, the bezel occupies a relatively small area, and a narrow bezel can be achieved.

Figure 4:
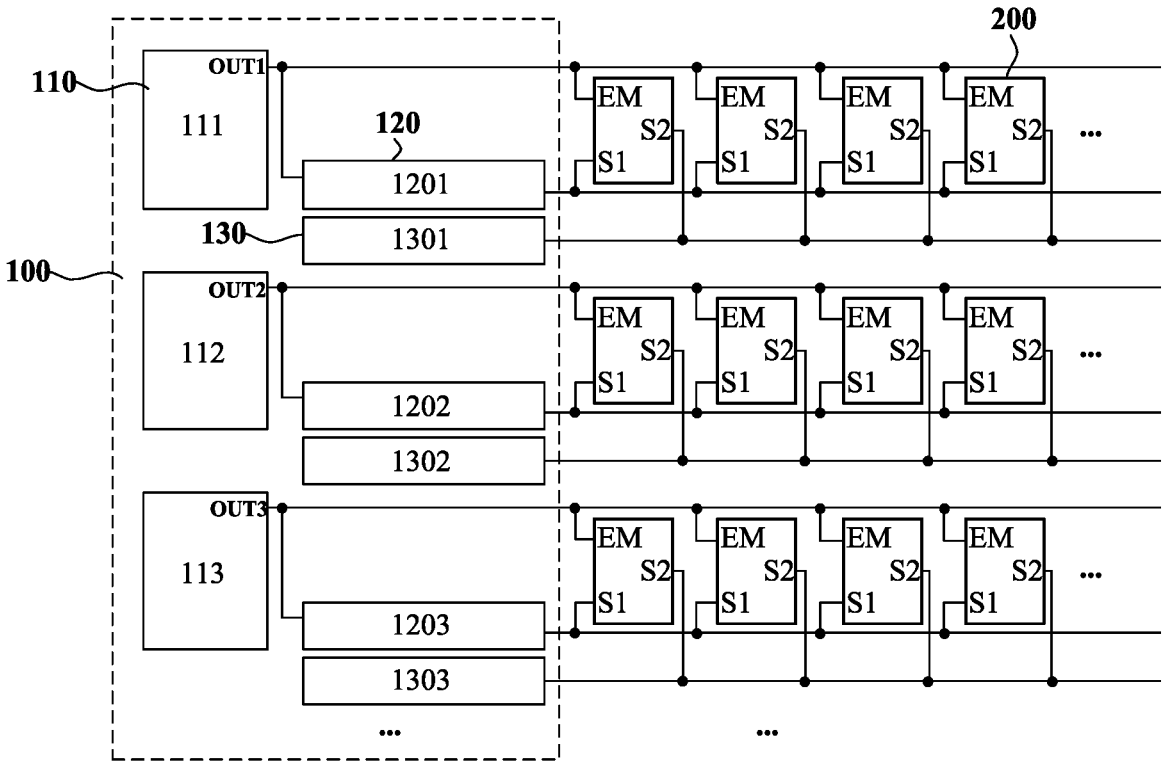
FIG. 4 is a schematic diagram of another display panel according to an embodiment of the present disclosure.

Referring to FIG. 4, FIG. 4 is a schematic diagram of another display panel according to an embodiment of the present disclosure. As shown in FIG. 4, in an embodiment, the gate driver circuit 100 further includes stages of cascaded second scan drive devices 130 and the plurality of stages of cascaded second scan drive devices 130 provide second scan drive signals to the plurality of rows of pixels.

In the present embodiment, the pixel circuit 200 further includes a second scan drive terminal S2.

The gate driver circuit 100 further includes the plurality of stages of cascaded second scan drive devices 130. Only the plurality of stages of second scan drive devices 130 are shown in FIG. 4 and a manner in which the plurality of stages of second scan drive devices 130 are cascaded is not shown. The second scan drive devices with different scanning manners in different display panels may be cascaded in different manners, which is not specifically illustrated here. One stage of second scan drive device 130 is disposed in correspondence to a row of pixels. An output terminal of the second scan drive device 130 is electrically connected to the second scan drive terminal S2 of each pixel circuit 200 in the corresponding row of pixels and the second scan drive device 130 is configured to provide the second scan drive signal to each pixel circuit 200 in the corresponding at least one row of pixels. The plurality of stages of second scan drive devices 130 are sequentially marked as a second scan drive device 1301, a second scan drive device 1302, a second scan drive device 1303 and so on.

In an embodiment, an enable scan signal in the first scan drive signal is greater than 0 V and an enable scan signal in the second scan drive signal is less than or equal to 0 V; or an enable scan signal in the first scan drive signal is less than or equal to 0 V and an enable scan signal in the second scan drive signal is greater than 0 V.

Figure 5:
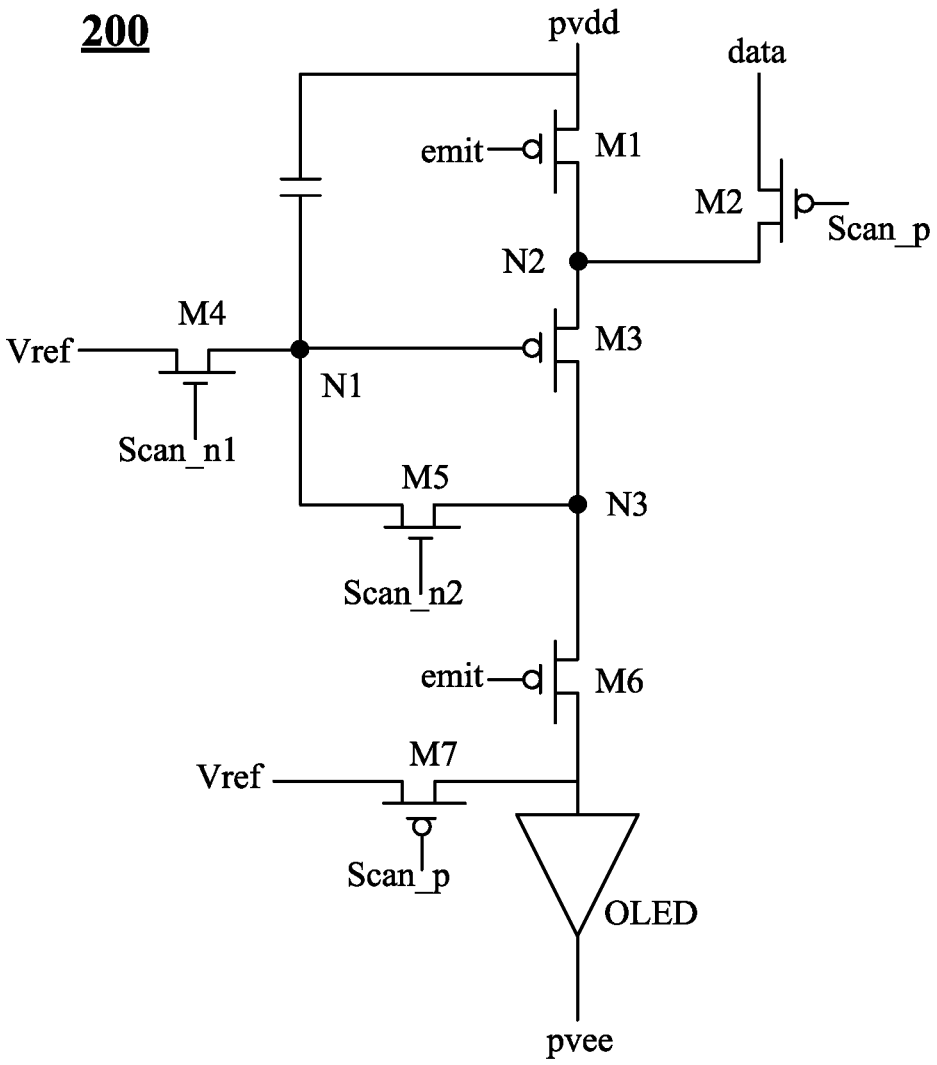
FIG. 5 is a schematic diagram of a pixel circuit according to an embodiment of the present disclosure.

Referring to FIG. 5, FIG. 5 is a schematic diagram of a pixel circuit according to an embodiment of the present disclosure. As shown in FIG. 5, in an embodiment, the input signal of the pixel circuit 200 at least includes a pulse signal scan_n (such as scan_n1 and scan_n2) containing a high potential enable scan signal and a pulse signal scan_p containing a low potential enable scan signal. Then, in an embodiment, the first scan drive device 120 may provide the pixel circuit 200 with the pulse signal scan_n containing the high potential enable scan signal and the second scan drive device 130 may provide the pixel circuit 200 with the pulse signal scan_p containing the low potential enable scan signal. In other embodiments, the first scan drive device may provide the pixel circuit with the pulse signal scan_p containing the low potential enable scan signal and the second scan drive device may provide the pixel circuit with the pulse signal scan_n containing the high potential enable scan signal.

It is to be understood that the pulse signal scan_n containing the high potential enable scan signal means that the pulse signal includes a high potential and a low potential, where a high potential pulse is the enable scan signal and a low potential pulse is a non-enable scan signal, that is, the high potential pulse in the pulse signal scan_n can control an electrically connected transistor to turn on and the low potential pulse in the pulse signal scan_n can control the electrically connected transistor to turn off. The pulse signal scan_p containing the low potential enable scan signal means that the pulse signal includes the high potential and the low potential, where the high potential pulse is the non-enable scan signal and the low potential pulse is the enable scan signal, that is, the high potential pulse in the pulse signal scan_p can control an electrically connected transistor to turn off and the low potential pulse in the pulse signal scan_p can control the electrically connected transistor to turn on.

It is to be noted that in some embodiments, the first scan drive device 120 in FIGS. 1 to 4 may provide the first scan drive terminal S1 of the pixel circuit 200 with a pulse signal scan_n1 containing a positive high potential enable scan signal, that is, the first scan drive device 120 may transmit the pulse signal through the first scan drive terminal S1 to control a transistor M4 in the pixel circuit 200 to turn on or off. In some other embodiments, the first scan drive device 120 in FIGS. 1 to 4 may provide the first scan drive terminal S1 of the pixel circuit 200 with a pulse signal scan_n2 containing the positive high potential enable scan signal, that is, the first scan drive device 120 may transmit the pulse signal through the first scan drive terminal S1 to control a transistor M5 in the pixel circuit 200 to turn on or off.

It is to be further noted that in some other embodiments, the signal scan_n required by the pixel circuit 200 includes scan_n1 and scan_n2. It is to be understood that scan_n1 and scan_n2 are from different scan_n signal lines. When adjacent rows of pixel circuits share a scan signal line, in conjunction with FIG. 3, assuming that a row of pixel circuits 200 is electrically connected to a first scan drive device 120, scan_n1 received by the row of pixel circuits 200 is from scan_n outputted by the corresponding first scan drive device 120 and scan_n2 received by the row of pixel circuits 200 is from scan_n1 outputted by the first scan drive device 120 in a next stage.

For example, the first scan drive device 120 provides the pixel circuit 200 with the pulse signal scan_n containing the high potential enable scan signal. In the related art, a scan1 drive device for providing the pulse signal scan_n to pixels needs to be specially designed in the non-display region and the wire, the structure and the like of the scan1 drive device need to be separately designed, which is complicated in structure and occupies a large area of the bezel. Alternatively, in the related art, an inverter may be added after the second scan drive device and the pulse signal scan_p outputted by the second scan drive device is outputted as the pulse signal scan_n containing the high potential enable scan signal through the inverter. Although the bezel is saved, the inverter has very poor operating stability and the pixel circuit is easy to operate abnormally, affecting a display effect.

In the present embodiment, the input terminal of the first scan drive device 120 is electrically connected to the output terminal OUT of the light emission drive device 110 and the light emission control signal outputted by the light emission drive device 110 is used as the input signal of the first scan drive device 120. Therefore, separate structures such as wires are not required to be disposed for the first scan drive device 120, a driver circuit for providing the pulse signal scan_n is simplified, the area of the bezel occupied by the first scan drive device 120 is reduced, and the narrow bezel is achieved. Moreover, the light emission drive device 110 outputs the light emission control signal stably, improving the stability of the first scan drive device 120, preventing the pixel circuit 200 from operating abnormally, and ensuring the display effect of the display panel.

It is to be understood that the pixel circuit shown in FIG. 5 is only an example of the pixel circuit. In actual production, a structure of the pixel circuit varies according to a type of the display panel and pixel circuits with different structures may be used in the same type of display panel. The preceding example is only an example of the pixel circuit, and the present disclosure is not limited thereto.

In an embodiment, a working process of the light emission drive device includes a luminescence stage and a non-luminescence stage and the non-luminescence stage includes a first non-luminescence stage and a second non-luminescence stage; in the first non-luminescence stage, the first scan drive device provides the non-enable sc an signal to the row of pixels; and in the second non-luminescence stage, the first scan drive device provides the enable scan signal to the row of pixels.

In the present embodiment, the working process of the light emission drive device includes the luminescence stage and the non-luminescence stage. When the light emission drive device is in the luminescence stage, the light emission control signal provided by the light emission drive device to the light emission control terminal of the pixel circuit may cause the light-emitting unit to emit light. When the light emission drive device is in the non-luminescence stage, the light emission control signal provided by the light emission drive device to the light emission control terminal of the pixel circuit will not cause the light-emitting unit to emit light.

Within some time periods of the non-luminescence stage, the first scan drive device provides the enable scan signal to each pixel circuit in the row of pixels. Within other time periods of the non-luminescence stage, the first scan drive device provides the non-enable scan signal to each pixel circuit in the row of pixels. It is to be understood that the first scan drive signal outputted by the first scan drive device includes the high potential pulse and the low potential pulse. A pulse in the first scan drive signal, which can turn on a corresponding switch in the pixel circuit, is the enable scan signal and a pulse in the first scan drive signal, which can turn off the corresponding switch in the pixel circuit, is the non-enable scan signal.

Referring to FIG. 5, the first scan drive device provides the first scan drive signal scan_n to each pixel circuit 200 in the corresponding row of pixels. The enable scan signal refers to a pulse in the first scan drive signal scan_n, which enables the corresponding transistor to turn on. The non-enable scan signal refers to a pulse in the first scan drive signal scan_n, which enables the corresponding transistor to turn off. In an embodiment, the transistor controlled by the first scan drive signal scan_n in the pixel circuit 200 is a Negative channel Metal Oxide Semiconductor (NMOS) transistor. Apparently, the high potential pulse in the first scan drive signal scan_n is the enable scan signal and the low potential pulse in the first scan drive signal scan_n is the non-enable scan signal.

Figure 6:
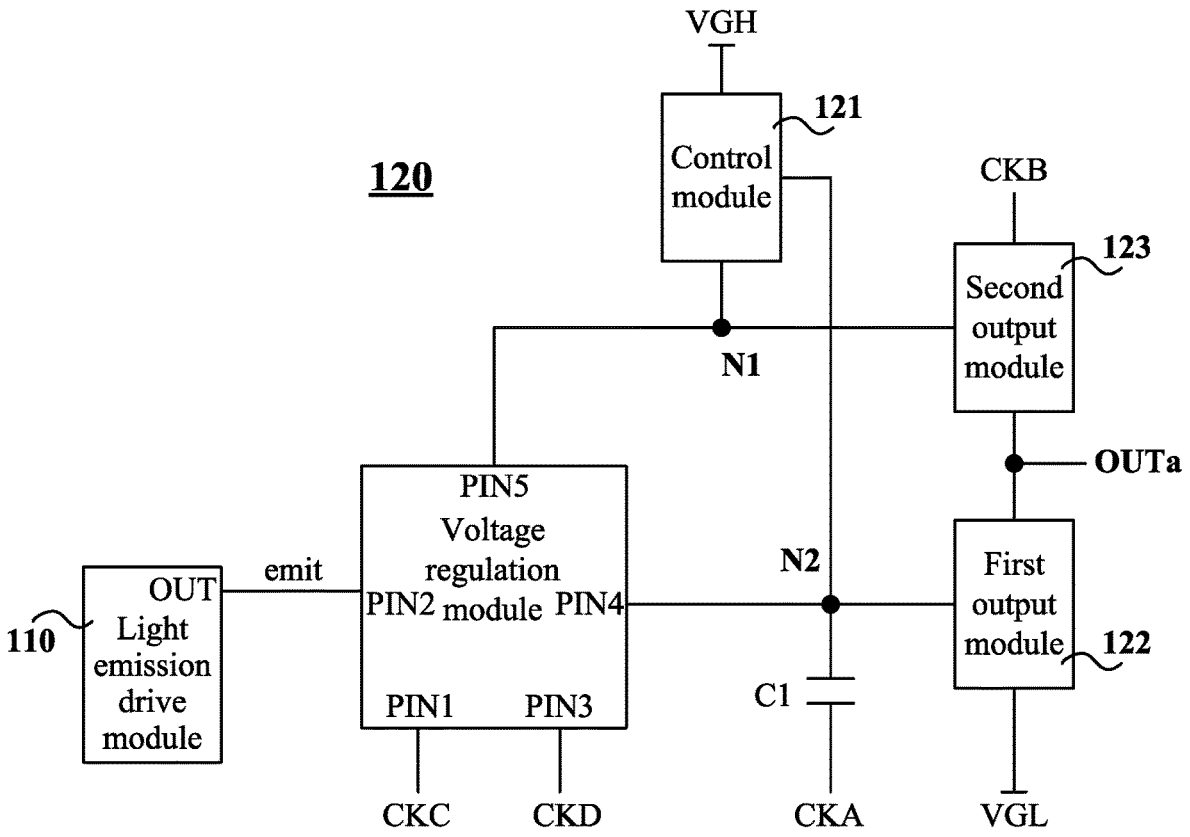
FIG. 6 is a partial schematic diagram of a gate driver circuit according to an embodiment of the present disclosure.

Referring to FIG. 6, FIG. 6 is a partial schematic diagram of a gate driver circuit according to an embodiment of the present disclosure. As shown in FIG. 6, in an embodiment, the first scan drive device 120 includes a control device 121, a first output device 122, a second output device 123 and a voltage regulation device 124; where a first capacitor C1 is coupled between a control terminal of the control device 121 and a first signal terminal CKA and the control device 121 is connected between a first voltage terminal VGH and a first node N1; a control terminal of the first output device 122 is connected to the control terminal of the control device 121 and the first output device 122 is connected between a second voltage terminal VGL and the output terminal OUTa of the first scan drive device 120; a control terminal of the second output device 123 is connected to the first node N1 and the second output device 123 is connected between a second signal terminal CKB and the output terminal OUTa of the first scan drive device 120; and the voltage regulation device 124 has a first terminal PIN1 connected to a third signal terminal CKC, a second terminal PIN2 connected to the output terminal OUT of the light emission drive device 110, a third terminal PIN3 connected to a fourth signal terminal CKD, a fourth terminal PIN4 connected to the control terminal of the control device 121 and a fifth terminal PIN5 connected to the first node N1.

In the present embodiment, if the control terminal of the control device 121 is a second node N2, the control terminal of the control device 121, the control terminal of the first output device 122 and the fourth terminal PIN4 of the voltage regulation device 124 are all connected to the second node N2. The first capacitor C1 is coupled between the second node N2 and the first signal terminal CKA. The first capacitor C1 is coupled between the control terminal of the control device 121 and the first signal terminal CKA and the control device 121 is connected between the first voltage terminal VGH and the first node N1. A first clock signal provided by the first signal terminal CKA includes a high potential pulse signal and a low potential pulse signal.

In the present embodiment, the first scan drive device 120 further includes the voltage regulation device 124, where the voltage regulation device 124 has the first terminal PIN1 connected to the third signal terminal CKC, the second terminal PIN2 connected to the output terminal OUT of the light emission drive device 110, the third terminal PIN3 connected to the fourth signal terminal CKD, the fourth terminal PIN4 connected to the control terminal of the control device 121 (the second node N2) and the fifth terminal PIN5 connected to the first node N1. The voltage regulation device 124 is configured to adjust potentials of the first node N1 and the second node N2.

The potential of the first node N1 controls the second output device 123 to turn on or off and the potential of the second node N2 controls the first output device 122 to turn on or off.

The potential of the second node N2 is determined by the voltage regulation device 124 and a first clock terminal CKA. The following cases are included.

In case (1), if the voltage regulation device 124 is turned on, the light emission control signal outputted from the output terminal OUT of the light emission drive device 110 is written to the second node N2 through the voltage regulation device 124 that is on. When the light emission control signal outputted by the light emission drive device 110 is a low potential signal, the potential of the second node N2 is the low potential. When the light emission control signal outputted by the light emission drive device 110 is a high potential signal, the potential of the second node N2 is the high potential.

In case (2), if the voltage regulation device 124 is turned off, a jump of the first clock signal provided by the first clock terminal CKA affects the potential of the second node N2. If an original potential of the second node N2 is the low potential after the voltage regulation device 124 is turned off, when the first clock signal provided by the first signal terminal CKA is the low potential pulse signal, the potential of the second node N2 is pulled down through coupling of the first capacitor C1 and thus is further decreased; when the first clock signal provided by the first signal terminal CKA is the high potential pulse signal, the potential of the second node N2 is pulled up through the coupling of the first capacitor C1. Typically, the potential of the second node N2 is pulled up to a relatively small degree and the potential of the second node N2 after pulled up is a low potential close to the original low potential of the second node N2. If the original potential of the second node N2 is the high potential after the voltage regulation device 124 is turned off, when the first clock signal provided by the first signal terminal CKA is the high potential pulse signal, the potential of the second node N2 is pulled up through the coupling of the first capacitor C1; when the first clock signal provided by the first signal terminal CKA is the low potential pulse signal, the potential of the second node N2 is pulled down through the coupling of the first capacitor C1 and thus is slightly decreased. It is to be understood that the potential of the second node N2 after pulled down is a high potential close to the original high potential of the second node N2.

The potential of the first node N1 is determined by the voltage regulation device 124, the control device 121 and a second clock terminal CKB. The second node N2 is used for controlling an on or off state of the control device 121. The potential of the first node N1 includes cases described below.

In case (1), if the second node N2 causes the control device 121 to be in the on state, the control device 121 receives a first voltage signal provided by the first voltage terminal VGH and transmits the first voltage signal to the first node N1.

In case (2), if the voltage regulation device 124 is turned on, a fourth clock signal provided by the fourth signal terminal CKD is written to the first node N1.

In case (3), if both the control device 121 and the voltage regulation device 124 are in the off state, the potential of the first node N1 is controlled by the second signal terminal CKB. Assuming that an original potential of the first node N1 is the low potential, when a second clock signal provided by the second signal terminal CKB is the low potential pulse signal, the potential of the first node N1 is pulled down through coupling and the potential of the first node N1 is lower than the original low potential of the first node N1; when the second clock signal provided by the second signal terminal CKB is the high potential pulse signal, the potential of the first node N1 is pulled up through coupling and the potential of the first node N1 after pulled up is a low potential close to the original low potential of the first node N1. Assuming that the original potential of the first node N1 is the high potential, when the second clock signal provided by the second signal terminal CKB is the high potential pulse signal, the potential of the first node N1 is pulled up through coupling and the potential of the first node N1 after pulled up is a high potential slightly higher than the original high potential; when the second clock signal provided by the second signal terminal CKB is the low potential pulse signal, the potential of the first node N1 is pulled down through coupling and the potential of the first node N1 after pulled down is a high potential close to the original high potential of the first node N1.

The control terminal of the first output device 122 is connected to the control terminal of the control device 121, that is, the second node N2, and the first output device 122 is connected between the second voltage terminal VGL and the output terminal OUTa of the first scan drive device 120. The potential of the second node N2 controls the on or off state of the first output device 122. If the potential of the second node N2 controls the first output device 122 to be in the on state, a potential of the output terminal OUTa of the first scan drive device 120 is pulled down to be the same as that of a second voltage signal from the second voltage terminal VGL. If the potential of the second node N2 controls the first output device 122 to be in the off state, the potential of the output terminal OUTa of the first scan drive device 120 is controlled by the second output device 123.

The control terminal of the second output device 123 is connected to the first node N1 and the second output device 123 is connected between the second signal terminal CKB and the output terminal OUTa of the first scan drive device 120. The potential of the first node N1 controls the on or off state of the second output device 123. If the potential of the first node N1 controls the second output device 123 to be in the on state, the output terminal OUTa of the first scan drive device 120 is determined by the second clock signal provided by the second signal terminal CKB. If the potential of the first node N1 controls the second output device 123 to be in the off state, the output terminal OUTa of the first scan drive device 120 is controlled by the first output device 122. It is to be understood that the second clock signal provided by the second signal terminal CKB includes the high potential pulse signal and the low potential pulse signal. When the second output device 123 is in the on state, the output terminal OUTa of the first scan drive device 120 is the second clock signal.

Figure 7:
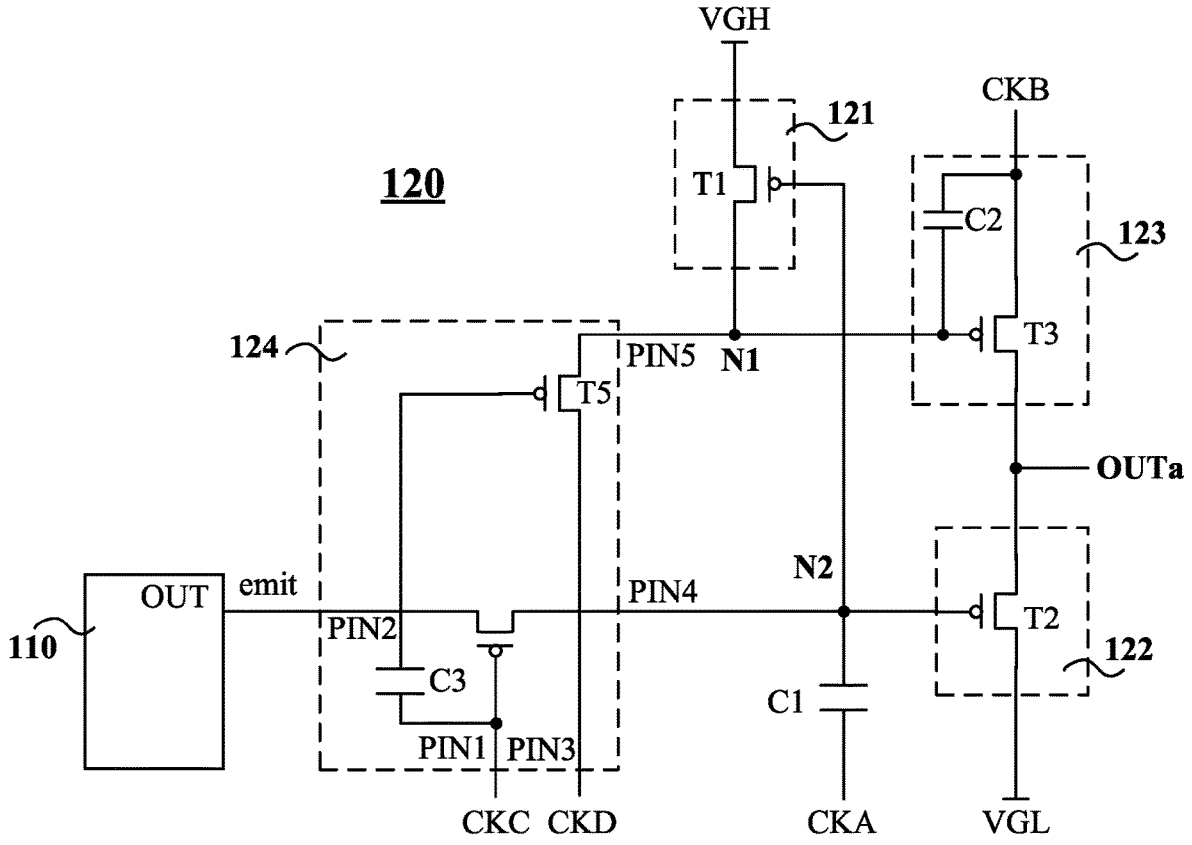
FIG. 7 is another partial schematic diagram of a gate driver circuit according to an embodiment of the present disclosure.

Referring to FIG. 7, FIG. 7 is another partial schematic diagram of a gate driver circuit according to an embodiment of the present disclosure. As shown in FIG. 7, in an embodiment, the control device 121 includes a first transistor T1; where the first capacitor C1 is coupled between a control terminal of the first transistor T1 and the first signal terminal CKA and the first transistor T1 is connected between the first voltage terminal VGH and the first node N1. In an embodiment, the first output device 122 includes a second transistor T2; where a control terminal of the second transistor T2 is connected to the control terminal N2 of the control device 121 and the second transistor T2 is connected between the second voltage terminal VGL and the output terminal OUTa of the first scan drive device 120. In an embodiment, the second output device 123 includes a third transistor T3 and a second capacitor C2; where a control terminal of the third transistor T3 is connected to the first node N1 and the third transistor T3 is connected between the second signal terminal CKB and the output terminal OUTa of the first scan drive device 120; and the second capacitor C2 is coupled between the second signal terminal CKB and the first node N1. In an embodiment, the voltage regulation device 124 includes a fourth transistor T4, a fifth transistor T5 and a third capacitor C3; where a control terminal of the fourth transistor T4 is connected to the third signal terminal CKC and the fourth transistor T4 is connected between the output terminal OUT of the light emission drive device 110 and the control terminal N2 of the control device 121; the third capacitor C3 is coupled between a control terminal of the fifth transistor T5 and the control terminal of the fourth transistor T4; and the fifth transistor T5 is connected between the first node N1 and the fourth signal terminal CKD.

In an embodiment, the first scan drive device 120 includes at least one transistor which is a Positive channel Metal Oxide Semiconductor (PMOS) transistor. It is to be understood that each transistor in the first scan drive device 120 may be the PMOS transistor, but in other embodiments, the transistors in the first scan drive device may be of different types, for example, may include the NMOS transistor and the PMOS transistor. Proper selection of the type of the transistor in the first scan drive device according to product requirements. In the present embodiment, an example in which each transistor in the first scan drive device 120 is the PMOS transistor is used.

In an embodiment, the first voltage terminal VGH provides the high potential signal and the second voltage terminal VGL provides the low potential signal. It is to be understood that the first voltage terminal and the second voltage terminal provide the first scan drive device 120 with the high potential signal and the low potential signal, respectively. According to circuit design requirements, the first voltage terminal VGH provides the high potential signal and the second voltage terminal VGL provides the low potential signal. It is to be noted that the high potential signal provided by the first voltage terminal VGH affects the potential of the first node N1 and the potential of the first node N1 controls the on or off state of the second output device 123 and the high potential signal needs to meet a requirement for controlling the on or off state of the second output device 123. Within at least some time periods, the low potential signal provided by the second voltage terminal VGL is transmitted to the output terminal OUTa of the first scan drive device 120 through the first output device 122 that is on and the low potential signal needs to meet a requirement for the low potential of the output terminal OUTa of the first scan drive device 120. Based on this, amplitudes of the voltage signals provided by the first voltage terminal VGH and the second voltage terminal VGL are not specifically repeated here. Design the amplitudes of the voltage signals provided by the first voltage terminal VGH and the second voltage terminal VGL according to product requirements.

In an embodiment, the second signal terminal CKB provides a first high potential signal and a first low potential signal, where the first high potential signal is the same as the high potential signal provided by the first voltage terminal VGH and the first low potential signal is the same as the low potential signal provided by the second voltage terminal VGL.

Figure 8:
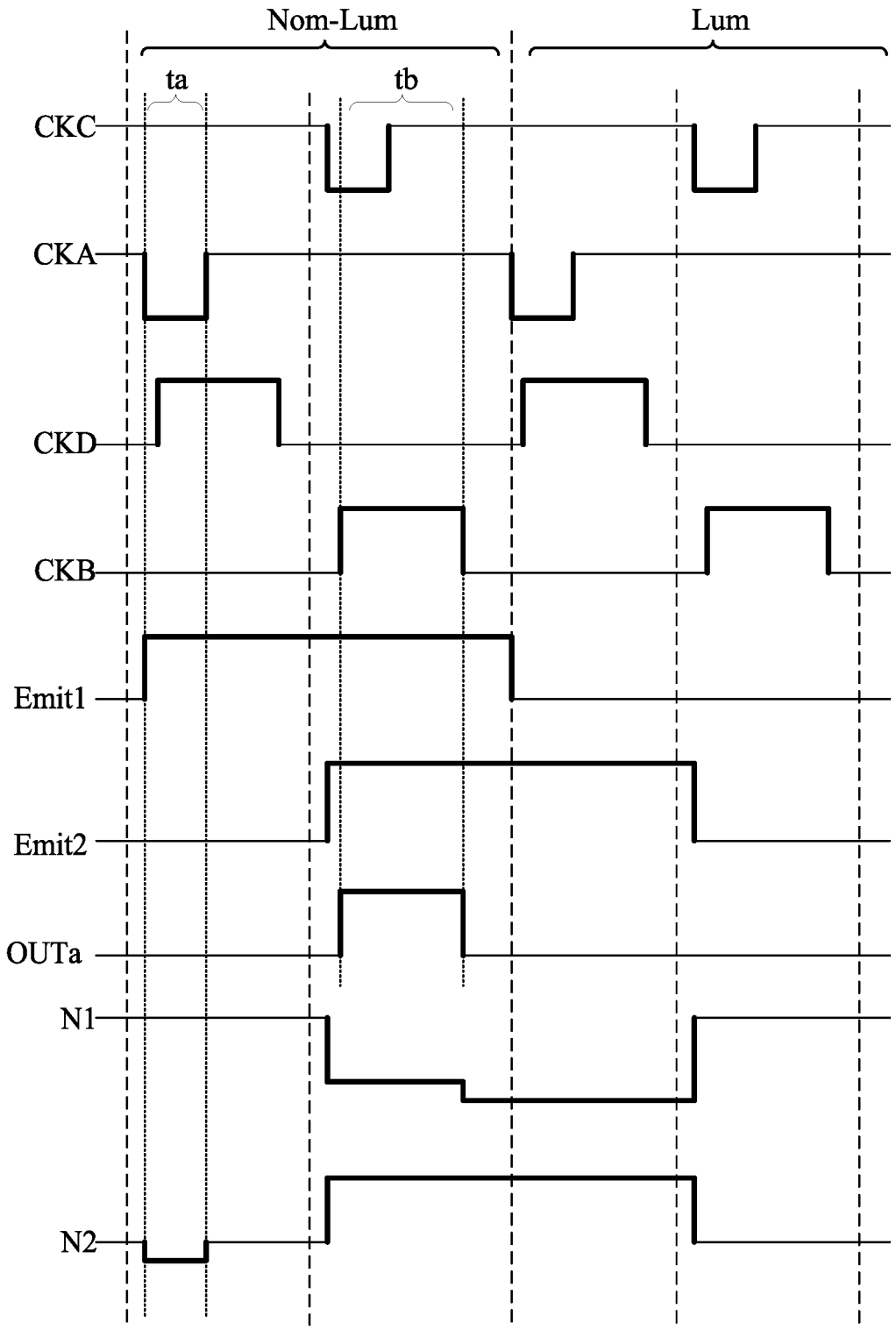
FIG. 8 is another timing diagram of a gate driver circuit according to an embodiment of the present disclosure.

Referring to FIG. 8, FIG. 8 is another timing diagram of a gate driver circuit according to an embodiment of the present disclosure. In conjunction with FIGS. 7 and 8, the working process of the gate driver circuit includes the luminescence stage Lum and the non-luminescence stage Non-Lum; in the first non-luminescence stage ta, the first scan drive device 120 provides the non-enable scan signal to the row of pixels; and in the second non-luminescence stage tb, the first scan drive device 120 provides the enable scan signal to the row of pixels. In the present embodiment, for example, the first scan drive device 120 provides the first scan drive signal scan_n; then, the non-enable scan signal in the first scan drive signal scan_n has the low potential to control the subsequent corresponding transistor to turn off and the enable scan signal in the first scan drive signal scan_n has the high potential to control the subsequent corresponding transistor to turn on.

In an embodiment, in the luminescence stage Lum, the light emission control signal emit outputted by the light emission drive device 110 has the low potential; in the non-luminescence stage Non-Lum, the light emission control signal emit outputted by the light emission drive device 110 has the high potential. In the luminescence stage Lum, if the third signal terminal CKC outputs the low potential signal, the voltage regulation device 124 is turned on and the low potential of the light emission control signal emit is written to the second node N2; if the third signal terminal CKC outputs the high potential signal, the voltage regulation device 124 is turned off and the second node N2 maintains the low potential.

In the first non-luminescence stage ta, if the third signal terminal CKC outputs the high potential signal, both the fourth transistor T4 and the fifth transistor T5 are turned off. At this time, the original potential of the second node N2 is the low potential, the first signal terminal CKA outputs the low potential signal and the potential of the second node N2 is pulled down through the coupling of the first capacitor C1 and the potential of the second node N2 is pulled down to be lower than the original low potential of the second node N2, ensuring that both the first transistor T1 and the second transistor T2 are turned on. If the first transistor T1 is turned on, the high potential signal provided by the first voltage terminal VGH is transmitted to the first node N1 and the third transistor T3 is turned off. Meanwhile, the second transistor T2 is turned on and the low potential signal provided by the second voltage terminal VGL is transmitted to the output terminal OUTa of the first scan drive device 120. The low potential signal is the non-enable scan signal and the subsequent corresponding transistor can be controlled to turn off.

In the second non-luminescence stage tb, if the third signal terminal CKC outputs the low potential signal, both the fourth transistor T4 and the fifth transistor T5 are turned on. If the fourth transistor T4 is turned on, the light emission control signal emit is inputted to the second node N2. In conjunction with the pixel circuit in FIG. 5, in the non-luminescence stage Non-Lum, the light emission control signal is the high potential signal and the second node N2 has the high potential and both the first transistor T1 and the second transistor T2 are turned off. Meanwhile, the fifth transistor T5 is turned on and the fourth signal terminal CKD outputs the low potential signal and the low potential of the fourth signal terminal CKD is written to the first node N1. If the potential of the first node N1 is the low potential, the third transistor T3 is turned on and the signal from the second signal terminal CKB is transmitted to the output terminal OUTa of the first scan drive device 120. At the current time, if the second signal terminal CKB outputs the high potential signal, the high potential signal is the enable scan signal and the subsequent corresponding transistor can be controlled to turn on.

It is to be noted that in the first non-luminescence stage ta, the fifth transistor T5 is turned off and the potential of the signal outputted by the fourth signal terminal CKD does not affect the potential of the first node N1. Therefore, the potential of the signal outputted by the fourth signal terminal CKD is not limited in the first non-luminescence stage ta and may be the high potential or the low potential. However, it is to be understood that if the fourth signal terminal CKD shares a common signal line with another signal terminal, the driving manner of the common signal line prevails. As shown in FIG. 8, in an embodiment, the potential of the signal outputted by the fourth signal terminal CKD is the high potential, but it is not limited thereto.

It is to be understood that the drive timing diagram shown in FIG. 8 is only an example. In an actual situation, an interval may exist between waveforms of a timing drive signal according to signal transmission.

Figure 9:
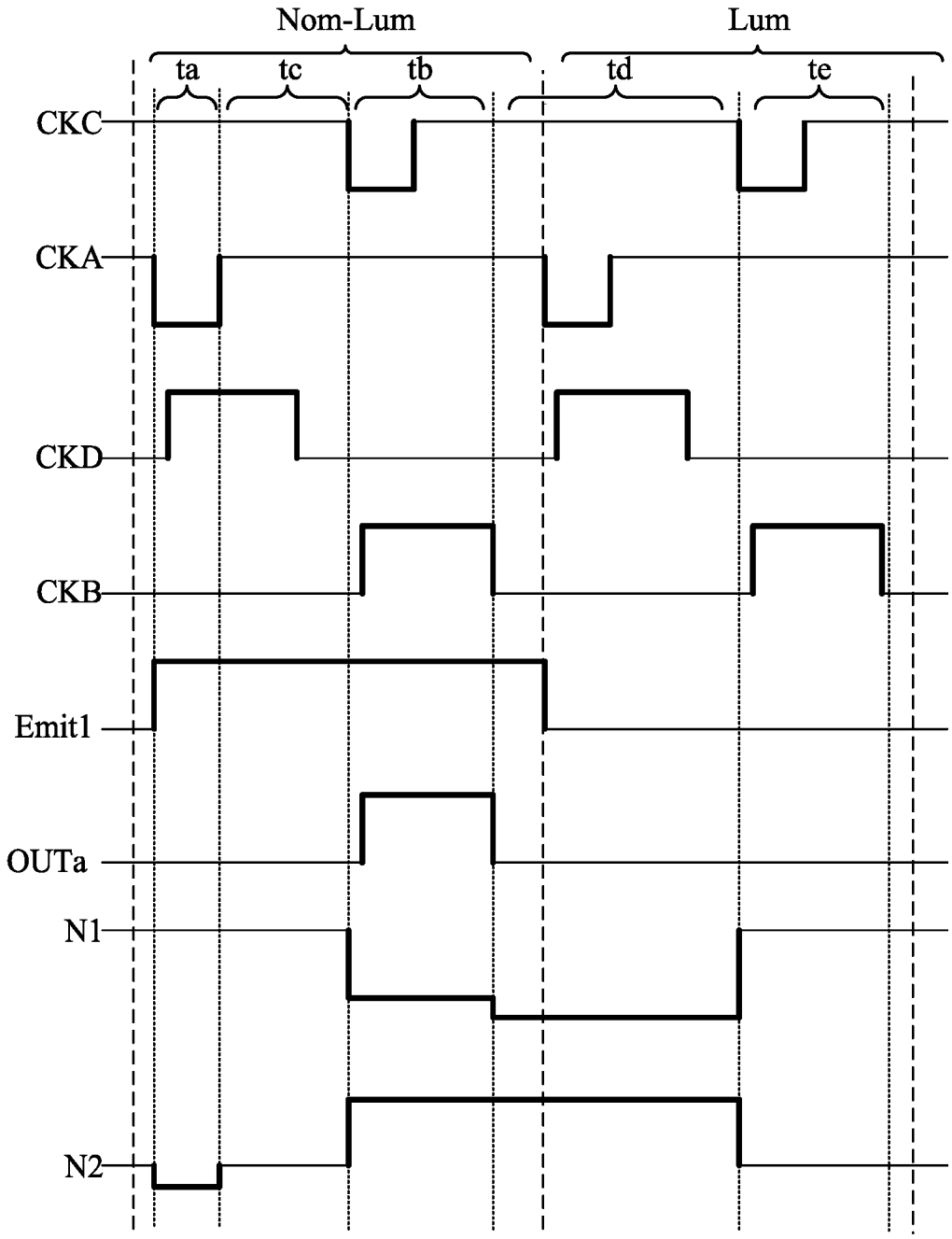
FIG. 9 is another timing diagram of a gate driver circuit according to an embodiment of the present disclosure.

Referring to FIG. 9, FIG. 9 is another timing diagram of a gate driver circuit according to an embodiment of the present disclosure. In conjunction with FIGS. 7 and 9, the working process of the gate driver circuit includes the luminescence stage Lum and the non-luminescence stage Non-Lum. The non-luminescence stage Non-Lum further includes a third non-luminescence stage tc. The first non-luminescence stage ta, the third non-luminescence stage tc and the second non-luminescence stage tb are executed in sequence. In the third non-luminescence stage tc, the second output device 123 is turned on and the non-enable scan signal is provided to the output terminal OUTa of the first scan drive device 120.

In the present embodiment, for example, the first scan drive device 120 provides the first scan drive signal scan_n; then, the non-enable scan signal in the first scan drive signal scan_n has the low potential to control the subsequent corresponding transistor to turn off and the enable scan signal in the first scan drive signal scan_n has the high potential to control the subsequent corresponding transistor to turn on. The working process in the first non-luminescence stage ta and the second non-luminescence stage tb is similar to that in FIG. 8 and not specifically repeated here.

The third non-luminescence stage tc is executed after the first non-luminescence stage ta. If the output of the third signal terminal CKC remains to be the high potential signal, the fourth transistor T4 and the fifth transistor T5 are off. The output of the first signal terminal CKA jumps to the high potential signal, the potential of the second node N2 is pulled up through the coupling of the first capacitor C1, and a degree to which the potential of the second node N2 is pulled up can almost offset a degree to which the potential of the second node N2 is pulled down in the first non-luminescence stage ta. Therefore, the potential of the second node N2 is restored to be equal to or close to the original low potential of the second node N2 in the first non-luminescence stage ta and both the first transistor T1 and the second transistor T2 are turned on. If the first node N1 maintains the high potential, the third transistor T3 is turned off. Meanwhile, the second transistor T2 is turned on and the low potential signal provided by the second voltage terminal VGL is transmitted to the output terminal OUTa of the first scan drive device 120. The low potential signal is the non-enable scan signal and the subsequent corresponding transistor can be controlled to turn off.

After the second non-luminescence stage tb, the gate driver circuit further includes a first driving stage td and a second driving stage te. In the first driving stage td, the second signal terminal CKB jumps from the high potential to the low potential. At this time, the first node N1 has the low potential and the potential of the first node N1 is pulled down through the coupling of the second capacitor C2 and the third transistor T3 remains on and the low potential signal provided by the second signal terminal CKB is transmitted to the output terminal OUTa of the first scan drive device 120. The low potential signal is the non-enable scan signal and the subsequent corresponding transistor can be controlled to turn off.

Next, in the second driving stage te, within a period after the second signal terminal CKB jumps from the low potential to the high potential, the third signal terminal CKC controls the fourth transistor T4 and the fifth transistor T5 to turn on and then turn off and the light emission control signal emit of the low potential is written to the second node N2 for the first transistor T1 and the second transistor T2 to be turned on. The second transistor T2 is turned on and the low potential signal provided by the second voltage terminal VGL is transmitted to the output terminal OUTa of the first scan drive device 120. Meanwhile, the first transistor T1 is turned on and the high potential signal provided by the first voltage terminal VGH is written to the first node N1 and the third transistor T3 is turned off.

In the present embodiment, the first scan drive signal outputted from the output terminal OUTa of the first scan drive device 120 is used for driving the corresponding row of pixel circuits. In the first non-luminescence stage to and the third non-luminescence stage tc, the second node N2 maintains the low potential to turn on the second transistor T2 and the output terminal OUTa of the first scan drive device 120 outputs the low potential signal of the second voltage terminal VGL. In the second non-luminescence stage tb, the first node N1 jumps to the low potential to turn on the third transistor T3 and the output terminal OUTa of the first scan drive device 120 outputs the high potential, which depends on the third transistor T3 that is on and the high potential pulse of the second signal terminal CKB. Then, the output from the output terminal OUTa of the first scan drive device 120 changes from the high potential to the low potential, which depends on the second signal terminal CKB jumping to the low potential. The second signal terminal CKB jumps to the low potential and the potential of the first node N1 is further pulled down to ensure that the third transistor T3 is turned on and the output terminal OUTa of the first scan drive device 120 maintains the output of the low potential signal of the second signal terminal CKB.

It is to be understood that the drive timing diagram shown in FIG. 9 is only an example. In the actual situation, an interval may exist between the waveforms of the timing drive signal according to the signal transmission.

Figure 10:
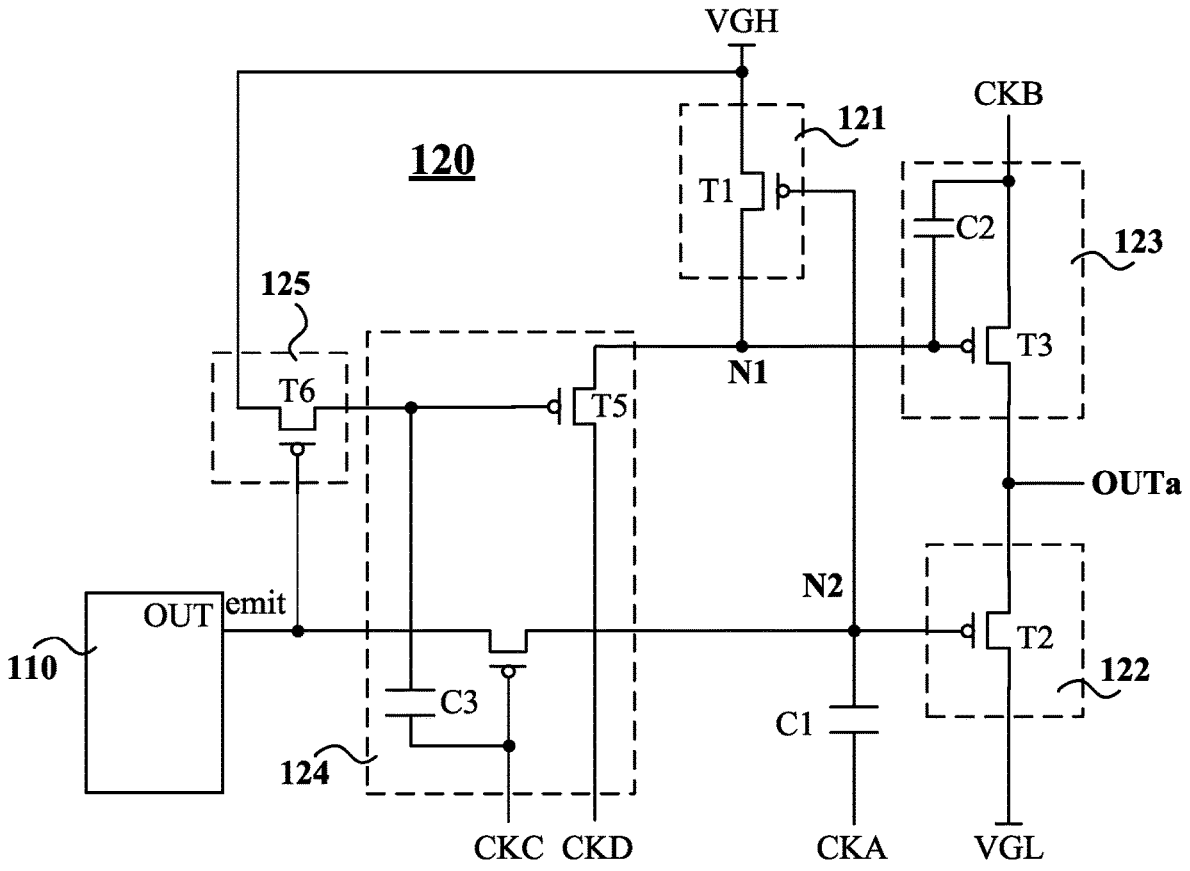
FIG. 10 is another partial schematic diagram of a gate driver circuit according to an embodiment of the present disclosure.
Figure 11:
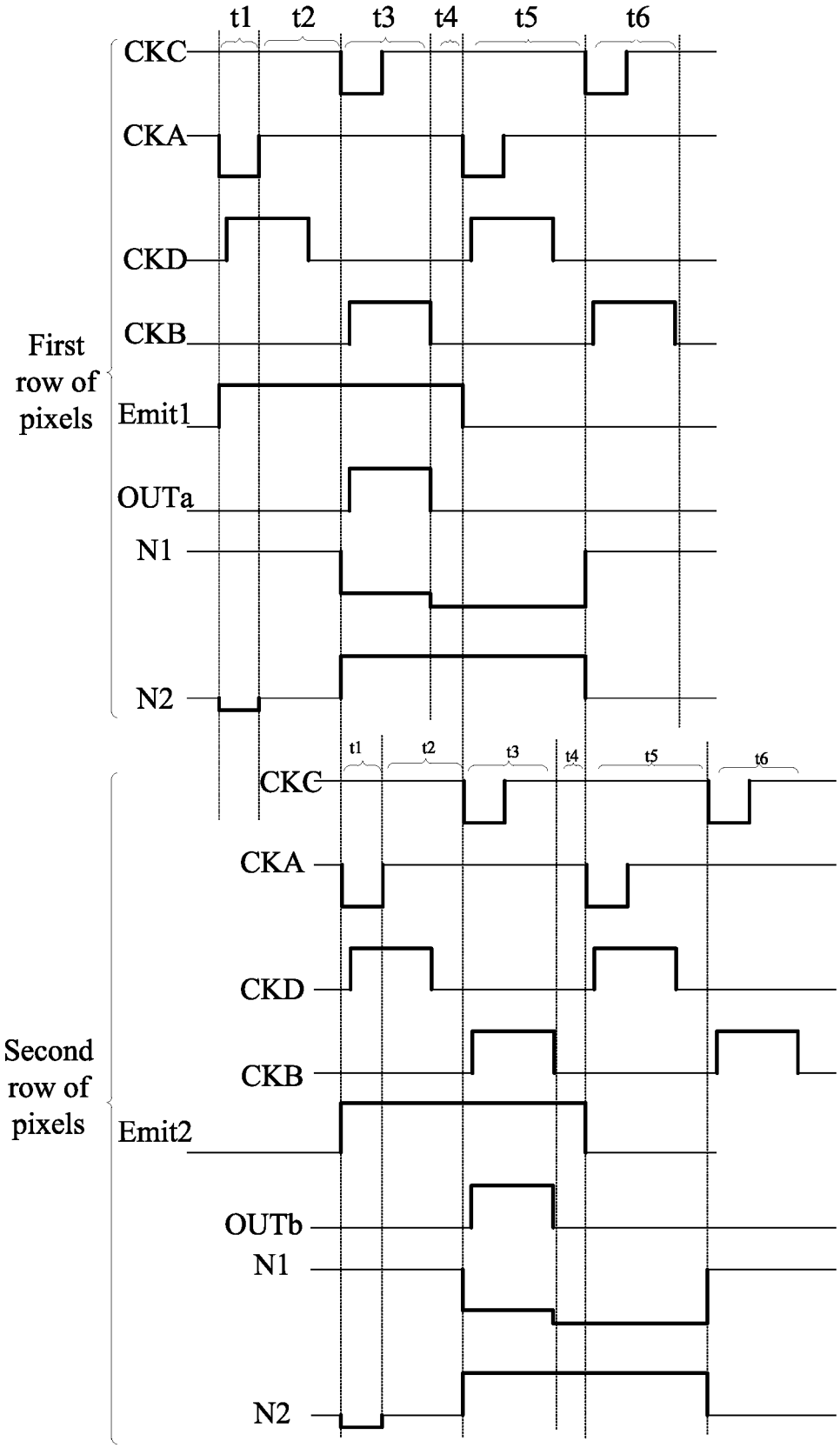
FIG. 11 is a timing diagram of two adjacent rows of pixel circuits according to an embodiment of the present disclosure.

Referring to FIG. 10, FIG. 10 is another partial schematic diagram of a gate driver circuit according to an embodiment of the present disclosure. Referring to FIG. 11, FIG. 11 is a timing diagram of two adjacent rows of pixel circuits according to an embodiment of the present disclosure. As shown in FIGS. 10 and 11, in an embodiment, the first scan drive device 120 further includes a turn-off device 125; where a control terminal of the turn-off device 125 is connected to the output terminal OUT of the light emission drive device 110 and the turn-off device 125 is connected between the first voltage terminal VGH and the control terminal of the fifth transistor T5. In an embodiment, the turn-off device 125 includes a sixth transistor T6; where a control terminal of the sixth transistor T6 is connected to the output terminal OUT of the light emission drive device 110 and the sixth transistor T6 is connected between the first voltage terminal VGH and the control terminal of the fifth transistor T5.

In the present embodiment, the control terminal of the turn-off device 125 is connected to the output terminal OUT of the light emission drive device 110, that is, for receiving the light emission control signal emit. In conjunction with the timing diagram in FIG. 11, assuming that outputs of two adjacent stages of first scan drive devices are OUTa and OUTb, respectively, a light emission control signal emit1 and OUTa outputted by the corresponding first scan drive device are used for driving a first row of pixels, and a light emission control signal emit2 and OUTb outputted by the corresponding first scan drive device are used for driving a second row of pixels.

Using the first row of pixels as an example, in the non-luminescence stage (including t1 to t4), the light emission control signal emit1 is the high potential signal; in the luminescence stage (including t5 and later stages), the light emission control signal emit1 is the low potential signal. In the non-luminescence stage, the light emission control signal emit1 is the high potential signal and the sixth transistor T6 is turned off and the potential of the control terminal of the fifth transistor T5 is not affected and thus the potential of the first node N1 is not affected. The potential of an output signal of the output terminal OUTa of the first scan drive device 120 is determined by the first output device 122 and the second output device 123. In the luminescence stage, the light emission control signal emit1 is the low potential signal and the sixth transistor T6 is turned on and the turn-off device 125 controls the fifth transistor T5 to turn off.

In an embodiment, in the luminescence stage, the sixth transistor T6 is turned on, the high potential signal provided by the first voltage terminal VGH is transmitted to the control terminal of the fifth transistor T5, and the potential of the control terminal of the fifth transistor T5 is stabilized to be the high potential and the fifth transistor T5 is turned off and the voltage regulation device 124 does not affect the potential of the first node N1. At this time, the potential of the first node N1 is determined by the second node N2, the control device 121 and the second signal terminal CKB. The output signal of the output terminal OUTa of the first scan drive device 120 is determined by the first output device 122 and the second output device 123.

A driving process of the first row of pixels is analyzed below in conjunction with FIGS. 10 and 11.

In a stage t1, the light emission control signal emit1 has the high potential, and the sixth transistor T6 is turned off; and the high potential signal provided by the third signal terminal CKC makes the fourth transistor T4 and the fifth transistor T5 turned off. At this time, the original potential of the second node N2 is the low potential. The potential of the second node N2 may be pulled down by the low potential signal provided by the first signal terminal CKA, to ensure that the first transistor T1 and the second transistor T2 are turned on. The first transistor T1 is turned on and the potential of the first node N1 is the high potential and the third transistor T3 is turned off. Meanwhile, the second transistor T2 is turned on, and the low potential signal provided by the second voltage terminal VGL is transmitted to the output terminal OUTa of the first scan drive device 120, where a first scan signal scan_n provided to the first row of pixels is the non-enable scan signal.

In a stage t2, the sixth transistor T6, the fourth transistor T4 and the fifth transistor T5 off, and the potential of the second node N2 may be pulled up by the high potential signal provided by the first signal terminal CKA to a degree which can almost offset a degree to which the potential of the second node N2 is pulled down in the stage t1. Therefore, the potential of the second node N2 is close to the original low potential thereof in the stage t1, to ensure that the first transistor T1 and the second transistor T2 are turned on. The first node N1 maintains the high potential, the third transistor T3 is turned off, and the first scan signal scan_n provided to the first row of pixels remains to be the non-enable scan signal.

In a stage t3, the sixth transistor T6 is off and the third signal terminal CKC provides the low potential signal and then the high potential signal. The low potential signal provided by the third signal terminal CKC makes the fourth transistor T4 and the fifth transistor T5 turned on. At this time, the light emission control signal emit1 is written to the second node N2 and has the high potential and the first transistor T1 and the second transistor T2 are turned off. The fifth transistor T5 is turned on, the low potential signal provided by the fourth signal terminal CKD is written to the first node N1 for the third transistor T3 to be turned on, and the high potential signal provided by the second signal terminal CKB is transmitted to the output terminal OUTa of the first scan drive device 120, where the first scan signal scan_n provided to the first row of pixels is the enable scan signal.

In a stage t4, the sixth transistor T6 is off, the high potential signal provided by the third signal terminal CKC makes the fourth transistor T4 and the fifth transistor T5 turned off. At this time, the second node N2 maintains the high potential and the first transistor T1 and the second transistor T2 are turned off. The second signal terminal CKB jumps to the low potential signal, and the potential of the first node N1 is pulled down to be a low potential lower, to ensure that the third transistor T3 is turned on. The low potential signal provided by the second signal terminal CKB is transmitted to the output terminal OUTa of the first scan drive device 120, where the first scan signal scan_n provided to the first row of pixels is the non-enable scan signal.

In a stage t5, the light emission control signal emit1 has the low potential, the sixth transistor T6 is turned on, the high potential signal provided by the first voltage terminal VGH makes the fifth transistor T5 turned off, the high potential signal provided by the third signal terminal CKC makes the fourth transistor T4 turned off, and a jump of the potential provided by the first signal terminal CKA stabilizes the second node N2 at the high potential and the first transistor T1 and the second transistor T2 are turned off. The potential of the first node N1 remains to be the low potential, to ensure that the third transistor T3 is turned on, and the low potential signal provided by the second signal terminal CKB is transmitted to the output terminal OUTa of the first scan drive device 120, where the first scan signal scan_n provided to the first row of pixels is the non-enable scan signal.

In a stage t6, the sixth transistor T6 is on and the fifth transistor T5 is off. The low potential signal provided by the third signal terminal CKC makes the fourth transistor T4 turned on and the low potential signal of the light emission control signal emit1 is written to the second node N2. The potential of the second node N2 is stabilized to be the low potential and the first transistor T1 and the second transistor T2 are turned on. The high potential signal provided by the first voltage terminal VGH is written to the first node N1 and the first node N1 is stabilized at the high potential and the third transistor T3 is turned off. Meanwhile, the low potential signal provided by the second voltage terminal VGL is transmitted to the output terminal OUTa of the first scan drive device 120, where the first scan signal scan_n provided to the first row of pixels is the non-enable scan signal.

Figure 12:
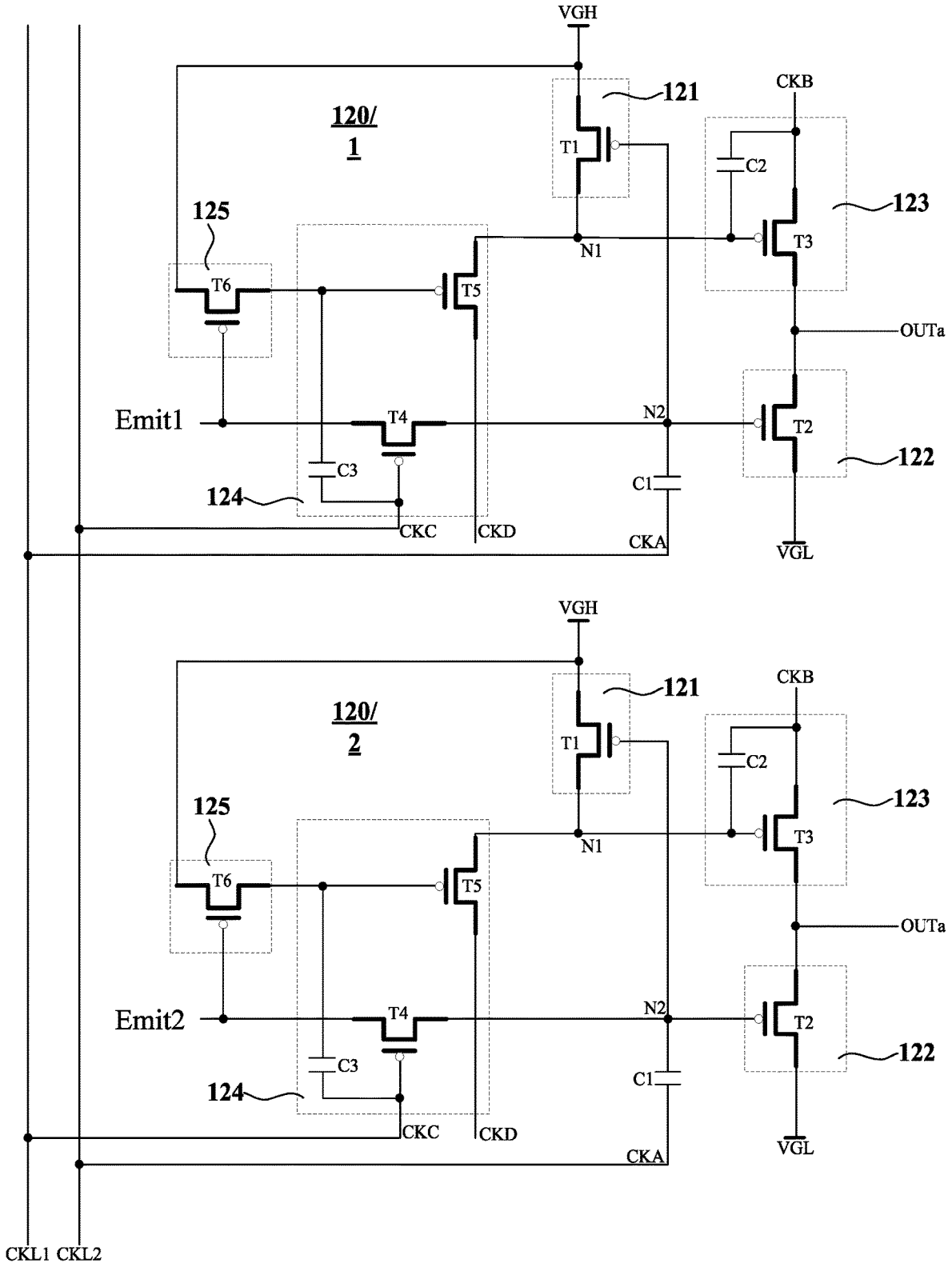
FIG. 12 is a schematic diagram of two adjacent stages of first scan drive devices according to an embodiment of the present disclosure.

Referring to FIG. 12, FIG. 12 is a schematic diagram of two adjacent stages of first scan drive devices according to an embodiment of the present disclosure. As shown in FIG. 12, in an embodiment, the gate driver circuit includes the plurality of stages of first scan drive devices 120 and each of the plurality of stages of first scan drive devices 120 is disposed in correspondence to a row of pixels; the display panel further includes a first signal line CKL1 and a second signal line CKL2; and for two adjacent stages of the plurality of stages of first scan drive devices 120, a first signal terminal CKA in a first scan drive device 120/1 in a current stage is connected to the first signal line CKL1 and a first signal terminal CKA in a first scan drive device 120/2 in a next stage is connected to the second signal line CKL2, and a third signal terminal CKC in the first scan drive device 120/1 in the current stage is connected to the second signal line CKL2 and a third signal terminal CKC in the first scan drive device 120/2 in the next stage is connected to the first signal line CKL1.

In the present embodiment, it is to be understood that the two adjacent stages of first scan drive devices 120 are configured to drive two adjacent rows of pixels. It can be known in conjunction with FIG. 11 that among the plurality of stages of first scan drive devices 120, the first signal terminal CKA in the first scan drive device 120/1 in the current stage and the third signal terminal CKC in the first scan drive device 120/2 in the next stage have the same drive timing and thus may be connected to the same signal line, in an embodiment, the first signal line CKL1. The third signal terminal CKC in the first scan drive device 120/1 in the current stage and the first signal terminal CKA in the first scan drive device 120/2 in the next stage have the same drive timing and thus may be connected to the same signal line, in an embodiment, the second signal line CKL2. In this manner, the number of wires required by the plurality of stages of first scan drive devices 120 is reduced, the area of the bezel is saved, and the narrow bezel is achieved.

Figure 13:
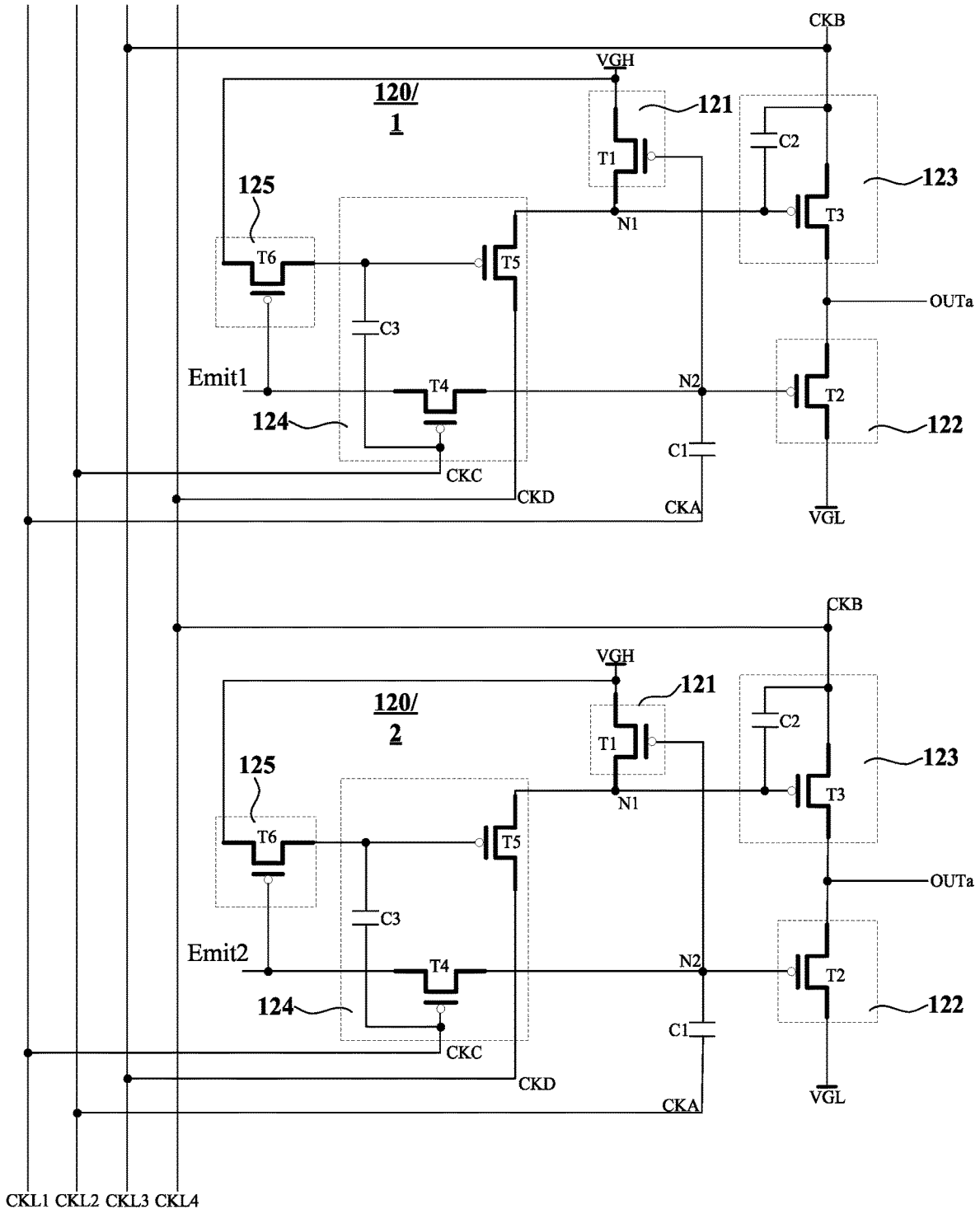
FIG. 13 is another schematic diagram of two adjacent stages of first scan drive devices according to an embodiment of the present disclosure.

Referring to FIG. 13, FIG. 13 is another schematic diagram of two adjacent stages of first scan drive devices according to an embodiment of the present disclosure. As shown in FIG. 13, in an embodiment, the gate driver circuit includes the plurality of stages of first scan drive devices 120 and each of the plurality of stages of first scan drive devices 120 is disposed in correspondence to a row of pixels; the display panel further includes a third signal line CKL3 and a fourth signal line CKL4; and for the two adjacent stages of the plurality of stages of first scan drive devices 120, a fourth signal terminal CKD in the first scan drive device 120/1 in the current stage is connected to the fourth signal line CKL4 and a fourth signal terminal CKD in the first scan drive device 120/2 in the next stage is connected to the third signal line CKL3, and a second signal terminal CKB in the first scan drive device 120/1 in the current stage is connected to the third signal line CKL3 and a second signal terminal CKB in the first scan drive device 120/2 in the next stage is connected to the fourth signal line CKL4.

In the present embodiment, it is to be understood that the two adjacent stages of first scan drive devices 120 are configured to drive two adjacent rows of pixels. It can be known in conjunction with FIG. 11 that among the plurality of stages of first scan drive devices 120, the fourth signal terminal CKD in the first scan drive device 120/1 in the current stage and the second signal terminal CKB in the first scan drive device 120/2 in the next stage have the same drive timing and thus may be connected to the same signal line, in an embodiment, the fourth signal line CKL4. The second signal terminal CKB in the first scan drive device 120/1 in the current stage and the fourth signal terminal CKD in the first scan drive device 120/2 in the next stage have the same drive timing and thus may be connected to the same signal line, in an embodiment, the third signal line CKL3. In this manner, the number of wires required by the plurality of stages of first scan drive devices 120 is reduced, the area of the bezel is saved, and the narrow bezel is achieved.

Figure 14:
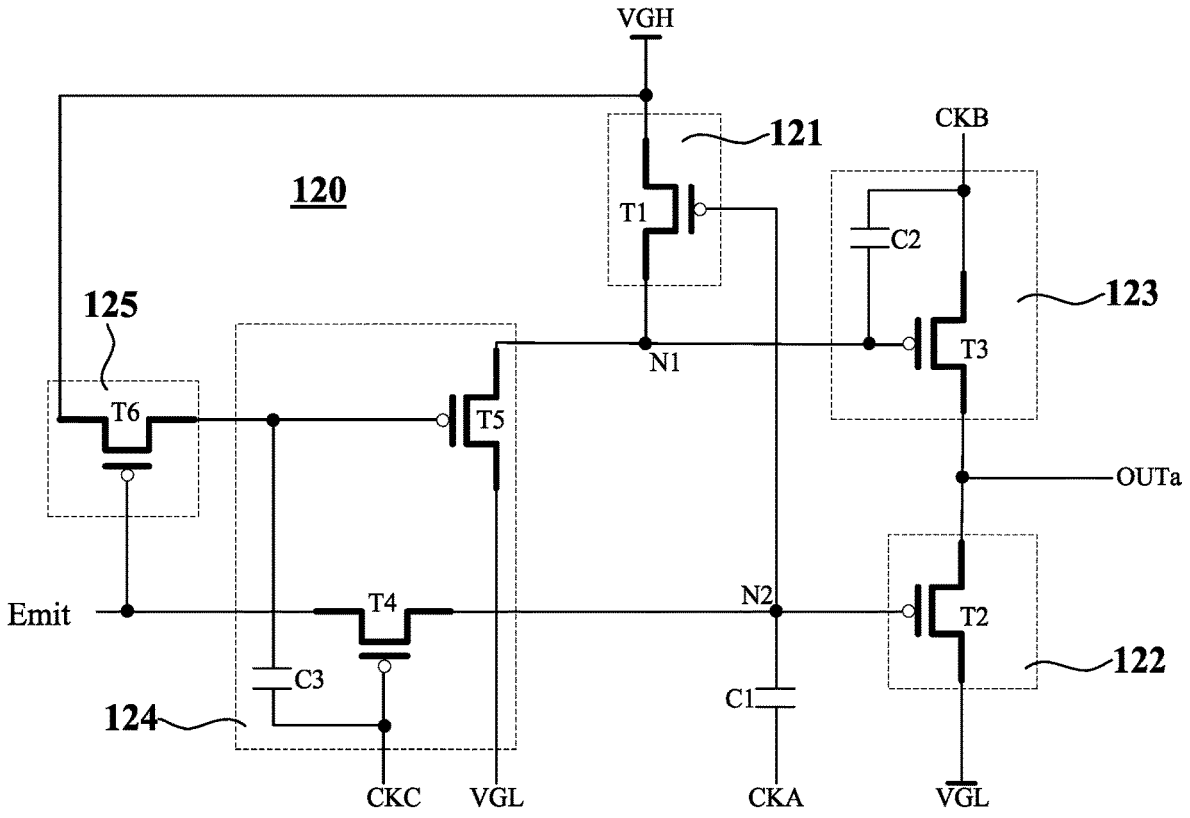
FIG. 14 is a schematic diagram of a first scan drive device according to an embodiment of the present disclosure.

Referring to FIG. 14, FIG. 14 is a schematic diagram of a first scan drive device according to an embodiment of the present disclosure. As shown in FIG. 14, in an embodiment, the second voltage terminal VGL also serves as the fourth signal terminal CKD. FIG. 14 differs from FIG. 10 in that the second voltage terminal VGL and the fourth signal terminal CKD are connected to the same signal line, second signal terminals CKB in first scan drive devices in odd-numbered stages are connected to the same signal line, and second signal terminals CKB in first scan drive devices in even-numbered stages are connected to another signal line.

Figure 15:
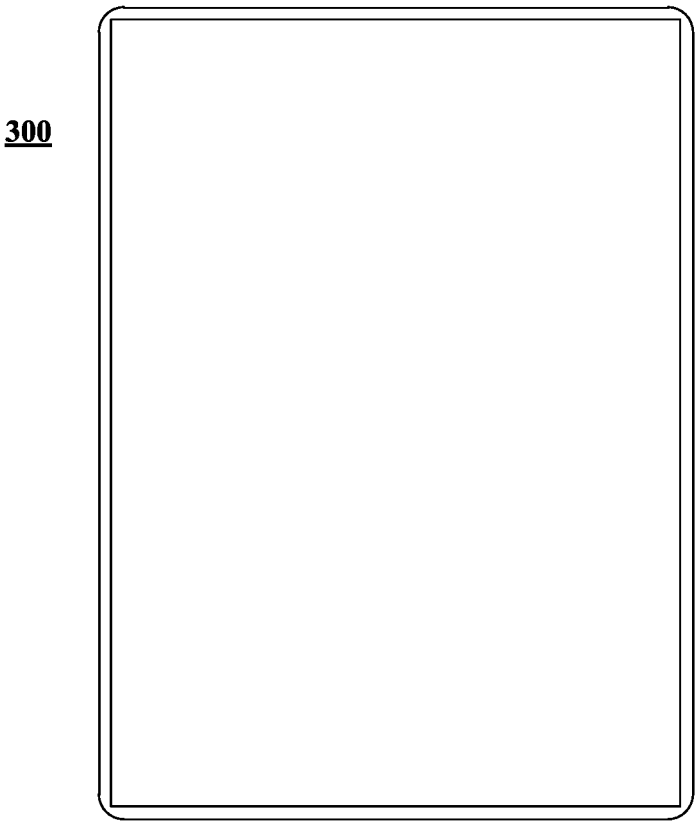
FIG. 15 is a schematic diagram of a smart device according to an embodiment of the present disclosure.

Based on the same concept, the embodiments of the present disclosure further provide a display device including the display panel according to any one of the embodiments described above. In an embodiment, the display panel is, but not limited to, an organic light-emitting display panel. In an embodiment, the display device may be applied to smart devices such as a smartphone. Referring to FIG. 15, FIG. 15 is a schematic diagram of a smart device according to an embodiment of the present disclosure. A smart device 300 includes the display panel according to any one of the embodiments described above.

In the present embodiment, a bezel of the display panel is provided with a gate driver circuit. The gate driver circuit includes stages of light emission drive devices, each of the plurality of stages of light emission drive devices provides a light emission control signal to a corresponding row of pixels, and the light emission control signal is a light emission control signal emit required by a pixel circuit. The gate driver circuit further includes at least one stage of first scan drive device and the first scan drive device provides a first scan drive signal to a corresponding row of pixels. In an embodiment, the first scan drive signal is a scan drive signal "scan_n" required by the pixel circuit.

The gate driver circuit further includes stages of cascaded second scan drive devices and each of stages of cascaded second scan drive devices provides a second scan drive signal to a corresponding row of pixels. In an embodiment, the second scan drive signal is a scan drive signal "scan_p" required by the pixel circuit.

It is to be noted that an input terminal of the first scan drive device is connected to an output terminal of the light emission drive device and it is known that the output terminal of the light emission drive device outputs the light emission control signal. Therefore, as an input signal of the first scan drive device, the light emission control signal is used for driving the first scan drive device to generate the first scan drive signal and a separate wire of the input signal is not required to be disposed for the first scan drive device and a bezel can be saved. Moreover, the first scan drive device generates the first scan drive signal according to the light emission control signal, which has a simple circuit structure, good operating stability and a more flexible and adjustable circuit design.

What is claimed is:

1. A display panel, comprising: a plurality of rows of pixels and a gate driver circuit; wherein each pixel among the plurality of rows of pixels comprises a pixel circuit and the pixel circuit comprises a light emission control terminal and a first scan drive terminal;

the gate driver circuit comprises a plurality of stages of light emission drive devices, wherein each of the plurality of stages of light emission drive devices is disposed in correspondence to at least one row of pixel circuits and configured to provide a light emission control signal to the light emission control terminal of the pixel circuit; and the gate driver circuit further comprises at least one stage of first scan drive device, wherein an input terminal of a first scan drive device is connected to an output terminal of a light emission drive device, an output terminal of the first scan drive device is connected to the first scan drive terminal of the pixel circuit, and the first scan drive device is driven by the light emission control signal to provide a first scan drive signal to a row of pixels; and the output terminal of the light emission drive device is connected to the light emission control terminal;

wherein the first scan drive device comprises a control device, a first output device, a second output device and a voltage regulation device;

wherein a first capacitor is coupled between a control terminal of the control device and a first signal terminal and the control device is connected between a first voltage terminal and a first node;

wherein a control terminal of the first output device is connected to the control terminal of the control device and the first output device is connected between a second voltage terminal and the output terminal of the first scan drive device;

wherein a control terminal of the second output device is connected to the first node and the second output device is connected between a second signal terminal and the output terminal of the first scan drive device; and wherein the voltage regulation device has a first terminal connected to a third signal terminal, a second terminal connected to the output terminal of the light emission drive device, a third terminal connected to a fourth signal terminal, a fourth terminal connected to the control terminal of the control device and a fifth terminal connected to the first node.

2. The display panel according to claim 1, wherein the gate driver circuit comprises a plurality of stages of first scan drive devices, wherein each of the plurality of stages of first scan drive devices is disposed in correspondence to a respective one of the plurality of stages of light emission drive devices and an input terminal of the each of the plurality of stages of first scan drive devices is connected to an output terminal of a corresponding light emission drive device.

3. The display panel according to claim 1, wherein a working process of the gate driver circuit comprises a luminescence stage and a non-luminescence stage and the non-luminescence stage comprises a first non-luminescence stage and a second non-luminescence stage;

wherein in the first non-luminescence stage, the first scan drive device provides a non-enable scan signal to the row of pixels; and wherein in the second non-luminescence stage, the first scan drive device provides an enable scan signal to the row of pixels.

4. The display panel according to claim 1, wherein the control device comprises a first transistor; and wherein the first capacitor is coupled between a control terminal of the first transistor and the first signal terminal and the first transistor is connected between the first voltage terminal and the first node.

5. The display panel according to claim 1, wherein the first output device comprises a second transistor; and wherein a control terminal of the second transistor is connected to the control terminal of the control device and the second transistor is connected between the second voltage terminal and the output terminal of the first scan drive device.

6. The display panel according to claim 1, wherein the second output device comprises a third transistor and a second capacitor;

wherein a control terminal of the third transistor is connected to the first node and the third transistor is connected between the second signal terminal and the output terminal of the first scan drive device; and wherein the second capacitor is coupled between the second signal terminal and the first node.

7. The display panel according to claim 1, wherein the voltage regulation device comprises a fourth transistor, a fifth transistor and a third capacitor;

wherein a control terminal of the fourth transistor is connected to the third signal terminal and the fourth transistor is connected between the output terminal of the light emission drive device and the control terminal of the control device;

wherein the third capacitor is coupled between a control terminal of the fifth transistor and the control terminal of the fourth transistor; and wherein the fifth transistor is connected between the first node and the fourth signal terminal.

8. The display panel according to claim 7, wherein the first scan drive device further comprises a turn-off device; and wherein a control terminal of the turn-off device is connected to the output terminal of the light emission drive device and the turn-off device is connected between the first voltage terminal and the control terminal of the fifth transistor.

9. The display panel according to claim 8, wherein the turn-off device comprises a sixth transistor; and wherein a control terminal of the sixth transistor is connected to the output terminal of the light emission drive device and the sixth transistor is connected between the first voltage terminal and the control terminal of the fifth transistor.

10. The display panel according to claim 7, wherein the gate driver circuit comprises a plurality of stages of first scan drive devices and each of the plurality of stages of first scan drive devices is disposed in correspondence to a row of pixels;

wherein the display panel further comprises a first signal line and a second signal line; and wherein for two adjacent stages of the plurality of stages of first scan drive devices, a first signal terminal in a first scan drive device in a current stage is connected to the first signal line and a first signal terminal in a first scan drive device in a next stage is connected to the second signal line, and a third signal terminal in the first scan drive device in the current stage is connected to the second signal line and a third signal terminal in the first scan drive device in the next stage is connected to the first signal line.

11. The display panel according to claim 7, wherein the gate driver circuit comprises a plurality of stages of first scan drive devices and each of the plurality of stages of first scan drive devices is disposed in correspondence to a row of pixels;

wherein the display panel further comprises a third signal line and a fourth signal line;

wherein for two adjacent stages of the plurality of stages of first scan drive devices, a fourth signal terminal in a first scan drive device in a current stage is connected to the fourth signal line and a fourth signal terminal in a first scan drive device in a next stage is connected to the third signal line, and wherein a second signal terminal in the first scan drive device in the current stage is connected to the third signal line and a second signal terminal in the first scan drive device in the next stage is connected to the fourth signal line.

12. The display panel according to claim 1, wherein the second voltage terminal further serves as the fourth signal terminal.

13. The display panel according to claim 1, wherein the first scan drive device comprises at least one transistor which is a Positive channel Metal Oxide Semiconductor (PMOS) transistor.

14. The display panel according to claim 1, wherein the first voltage terminal provides a high potential signal and the second voltage terminal provides a low potential signal.

15. The display panel according to claim 1, wherein the second signal terminal provides a first high potential signal and a first low potential signal;

wherein the first high potential signal is the same as a high potential signal provided by the first voltage terminal and the first low potential signal is the same as a low potential signal provided by the second voltage terminal.

16. The display panel according to claim 1, wherein the gate driver circuit further comprises a plurality of stages of second scan drive devices cascaded and the plurality of stages of second scan drive devices cascaded provide a plurality of second scan drive signals to the plurality of rows of pixels.

17. The display panel according to claim 16, wherein an enable scan signal in the first scan drive signal is greater than 0 V and an enable scan signal in each of the plurality of stages of second scan drive signals is less than or equal to 0 V; or an enable scan signal in the first scan drive signal is less than or equal to 0 V and an enable scan signal in each of the plurality of stages of second scan drive signals is greater than 0 V.

18. A display device, comprising a display panel, wherein the display panel comprises: a plurality of rows of pixels and a gate driver circuit; wherein each pixel among the plurality of rows of pixels comprises a pixel circuit and the pixel circuit comprises a light emission control terminal and a first scan drive terminal;

the gate driver circuit comprises a plurality of stages of light emission drive devices, wherein each of the plurality of stages of light emission drive devices is disposed in correspondence to at least one row of pixel circuits and configured to provide a light emission control signal to the light emission control terminal of the pixel circuit; and the gate driver circuit further comprises at least one stage of first scan drive device, wherein an input terminal of the first scan drive device is connected to an output terminal of a light emission drive device, an output terminal of the first scan drive device is connected to the first scan drive terminal of the pixel circuit, and a first scan drive device is driven by the light emission control signal to provide a first scan drive signal to a row of pixels; and the output terminal of the light emission drive device is connected to the light emission control terminal;

wherein the first scan drive device comprises a control device, a first output device, a second output device and a voltage regulation device;

wherein a first capacitor is coupled between a control terminal of the control device and a first signal terminal and the control device is connected between a first voltage terminal and a first node;

wherein a control terminal of the first output device is connected to the control terminal of the control device and the first output device is connected between a second voltage terminal and the output terminal of the first scan drive device;

wherein a control terminal of the second output device is connected to the first node and the second output device is connected between a second signal terminal and the output terminal of the first scan drive device; and wherein the voltage regulation device has a first terminal connected to a third signal terminal, a second terminal connected to the output terminal of the light emission drive device, a third terminal connected to a fourth signal terminal, a fourth terminal connected to the control terminal of the control device and a fifth terminal connected to the first node.

19. The display device according to claim 18, wherein the gate driver circuit comprises a plurality of stages of first scan drive devices, wherein each of the plurality of stages of first scan drive devices is disposed in correspondence to a respective one of the plurality of stages of light emission drive devices and an input terminal of the each of the plurality of stages of first scan drive devices is connected to an output terminal of a corresponding light emission drive device.

* * * * *